US009867257B2

(12) United States Patent
Nathan et al.

(10) Patent No.: US 9,867,257 B2
(45) **Date of Patent: *Jan. 9, 2018**

(54) SYSTEM AND DRIVING METHOD FOR LIGHT EMITTING DEVICE DISPLAY

(71) Applicant: Ignis Innovation Inc., Waterloo (CA)

(72) Inventors: Arokia Nathan, Cambridge (GB); Gholamreza Chaji, Waterloo (CA); Stefan Alexander, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 691 days.

This patent is subject to a terminal disclaimer.

(21) Appl. No.: 14/466,084

(22) Filed: Aug. 22, 2014

(65) Prior Publication Data

US 2014/0361708 A1 Dec. 11, 2014

Related U.S. Application Data

(63) Continuation of application No. 14/094,175, filed on Dec. 2, 2013, which is a continuation of application (Continued)

(51) Int. Cl.
*H05B 33/08* (2006.01)
*G09G 3/3233* (2016.01)

(Continued)

(52) U.S. Cl.
CPC ..... *H05B 33/0896* (2013.01); *G09G 3/3233* (2013.01); *G09G 3/3241* (2013.01);

(Continued)

(58) Field of Classification Search
CPC ..... H05B 33/0896; H05B 33/083; G09G 3/3258; G09G 3/3291; G09G 3/325;

(Continued)

(56) References Cited

U.S. PATENT DOCUMENTS 3,506,851 A 4/1970 Polkinghom et al.
3,750,987 A 8/1973 Gobel (Continued)

FOREIGN PATENT DOCUMENTS

CA 2 523 841 1/2006
CA 2 567 076 1/2006

(Continued)

OTHER PUBLICATIONS

Ahnood et al.: "Effect of threshold voltage instability on field effect mobility in thin film transistors deduced from constant current measurements"; dated Aug. 2009.

(Continued)

*Primary Examiner* — Jonathan Horner
(74) *Attorney, Agent, or Firm* — Nixon Peabody LLP

(57) ABSTRACT

A light emitting device display, its pixel circuit and its driving technique is provided. The pixel includes a light emitting device and a plurality of transistors. A bias current and programming voltage data are provided to the pixel circuit in accordance with a driving scheme so that the current through the driving transistor to the light emitting device is adjusted.

5 Claims, 30 Drawing Sheets

Related U.S. Application Data

No. 12/425,734, filed on Apr. 17, 2009, now Pat. No. 8,614,652.

(60) Provisional application No. 61/046,256, filed on Apr. 18, 2008.

(51) Int. Cl.

| | |
|---|---|
| ***G09G 3/3283*** | (2016.01) |
| ***G09G 3/3291*** | (2016.01) |
| ***G09G 3/3258*** | (2016.01) |
| ***G09G 3/3241*** | (2016.01) |

(52) U.S. Cl.

CPC ..... *G09G 3/3258* (2013.01); *G09G 3/3283* (2013.01); *G09G 3/3291* (2013.01); *H05B 33/083* (2013.01); *G09G 2300/043* (2013.01); *G09G 2300/0819* (2013.01); *G09G 2300/0852* (2013.01); *G09G 2300/0861* (2013.01); *G09G 2310/0262* (2013.01); *G09G 2320/0252* (2013.01); *G09G 2320/043* (2013.01); *G09G 2320/045* (2013.01)

(58) Field of Classification Search

CPC ..... G09G 3/3283; G09G 2300/0852; G09G 2300/0819; G09G 2300/043; G09G 2300/0861; G09G 2310/0262; G09G 2320/0252; G09G 2320/043; G09G 2320/045

See application file for complete search history.

(56) References Cited

U.S. PATENT DOCUMENTS

| | | | |
|---|---|---|---|
| 3,774,055 | A | 11/1973 | Bapat et al. |
| 4,090,096 | A | 5/1978 | Nagami |
| 4,354,162 | A | 10/1982 | Wright |
| 4,996,523 | A | 2/1991 | Bell et al. |
| 5,134,387 | A | 7/1992 | Smith et al. |
| 5,153,420 | A | 10/1992 | Hack et al. |
| 5,170,158 | A | 12/1992 | Shinya |
| 5,204,661 | A | 4/1993 | Hack et al. |
| 5,266,515 | A | 11/1993 | Robb et al. |
| 5,278,542 | A | 1/1994 | Smith et al. |
| 5,408,267 | A | 4/1995 | Main |
| 5,498,880 | A | 3/1996 | Lee et al. |
| 5,572,444 | A | 11/1996 | Lentz et al. |
| 5,589,847 | A | 12/1996 | Lewis |
| 5,619,033 | A | 4/1997 | Weisfield |
| 5,648,276 | A | 7/1997 | Hara et al. |
| 5,670,973 | A | 9/1997 | Bassetti et al. |
| 5,691,783 | A | 11/1997 | Numao et al. |
| 5,701,505 | A | 12/1997 | Yamashita et al. |
| 5,714,968 | A | 2/1998 | Ikeda |
| 5,744,824 | A | 4/1998 | Kousai et al. |
| 5,745,660 | A | 4/1998 | Kolpatzik et al. |
| 5,748,160 | A | 5/1998 | Shieh et al. |
| 5,758,129 | A | 5/1998 | Gray et al. |
| 5,835,376 | A | 11/1998 | Smith et al. |
| 5,870,071 | A | 2/1999 | Kawahata |
| 5,874,803 | A | 2/1999 | Garbuzov et al. |
| 5,880,582 | A | 3/1999 | Sawada |
| 5,903,248 | A | 5/1999 | Irwin |
| 5,917,280 | A | 6/1999 | Burrows et al. |
| 5,949,398 | A | 9/1999 | Kim |
| 5,952,789 | A | 9/1999 | Stewart et al. |
| 5,990,629 | A | 11/1999 | Yamada et al. |
| 6,023,259 | A | 2/2000 | Howard et al. |
| 6,069,365 | A | 5/2000 | Chow et al. |
| 6,091,203 | A | 7/2000 | Kawashima et al. |
| 6,097,360 | A | 8/2000 | Holloman |
| 6,100,868 | A | 8/2000 | Lee et al. |
| 6,144,222 | A | 11/2000 | Ho |
| 6,229,506 | B1 | 5/2001 | Dawson et al. |
| 6,229,508 | B1 | 5/2001 | Kane |
| 6,246,180 | B1 | 6/2001 | Nishigaki |
| 6,252,248 | B1 | 6/2001 | Sano et al. |
| 6,268,841 | B1 | 7/2001 | Cairns et al. |
| 6,288,696 | B1 | 9/2001 | Holloman |
| 6,307,322 | B1 | 10/2001 | Dawson et al. |
| 6,310,962 | B1 | 10/2001 | Chung et al. |
| 6,323,631 | B1 | 11/2001 | Juang |
| 6,333,729 | B1 | 12/2001 | Ha |
| 6,388,653 | B1 | 5/2002 | Goto et al. |
| 6,392,617 | B1 | 5/2002 | Gleason |
| 6,396,469 | B1 | 5/2002 | Miwa et al. |
| 6,414,661 | B1 | 7/2002 | Shen et al. |
| 6,417,825 | B1 | 7/2002 | Stewart et al. |
| 6,430,496 | B1 | 8/2002 | Smith et al. |
| 6,433,488 | B1 | 8/2002 | Bu |
| 6,473,065 | B1 | 10/2002 | Fan |
| 6,475,845 | B2 | 11/2002 | Kimura |
| 6,501,098 | B2 | 12/2002 | Yamazaki |
| 6,501,466 | B1 | 12/2002 | Yamagishi et al. |
| 6,522,315 | B2 | 2/2003 | Ozawa et al. |
| 6,535,185 | B2 | 3/2003 | Kim et al. |
| 6,542,138 | B1 | 4/2003 | Shannon et al. |
| 6,559,839 | B1 | 5/2003 | Ueno et al. |
| 6,580,408 | B1 | 6/2003 | Bae et al. |
| 6,583,398 | B2 | 6/2003 | Harkin |
| 6,618,030 | B2 | 9/2003 | Kane et al. |
| 6,639,244 | B1 | 10/2003 | Yamazaki et al. |
| 6,680,580 | B1 | 1/2004 | Sung |
| 6,686,699 | B2 | 2/2004 | Yumoto |
| 6,690,000 | B1 | 2/2004 | Muramatsu et al. |
| 6,693,610 | B2 | 2/2004 | Shannon et al. |
| 6,694,248 | B2 | 2/2004 | Smith et al. |
| 6,697,057 | B2 | 2/2004 | Koyama et al. |
| 6,724,151 | B2 | 4/2004 | Yoo |
| 6,734,636 | B2 | 5/2004 | Sanford et al. |
| 6,753,655 | B2 | 6/2004 | Shih et al. |
| 6,753,834 | B2 | 6/2004 | Mikami et al. |
| 6,756,741 | B2 | 6/2004 | Li |
| 6,777,888 | B2 | 8/2004 | Kondo |
| 6,781,567 | B2 | 8/2004 | Kimura |
| 6,788,231 | B1 | 9/2004 | Hsueh |
| 6,809,706 | B2 | 10/2004 | Shimoda |
| 6,828,950 | B2 | 12/2004 | Koyama |
| 6,858,991 | B2 | 2/2005 | Miyazawa |
| 6,859,193 | B1 | 2/2005 | Yumoto |
| 6,876,346 | B2 | 4/2005 | Anzai et al. |
| 6,900,485 | B2 | 5/2005 | Lee |
| 6,903,734 | B2 | 6/2005 | Eu |
| 6,911,960 | B1 | 6/2005 | Yokoyama |
| 6,911,964 | B2 | 6/2005 | Lee et al. |
| 6,914,448 | B2 | 7/2005 | Jinno |
| 6,919,871 | B2 | 7/2005 | Kwon |
| 6,924,602 | B2 | 8/2005 | Komiya |
| 6,937,220 | B2 | 8/2005 | Kitaura et al. |
| 6,940,214 | B1 | 9/2005 | Komiya et al. |
| 6,954,194 | B2 | 10/2005 | Matsumoto et al. |
| 6,970,149 | B2 | 11/2005 | Chung et al. |
| 6,975,142 | B2 | 12/2005 | Azami et al. |
| 6,975,332 | B2 | 12/2005 | Arnold et al. |
| 6,995,519 | B2 | 2/2006 | Arnold et al. |
| 7,027,015 | B2 | 4/2006 | Booth, Jr. et al. |
| 7,034,793 | B2 | 4/2006 | Sekiya et al. |
| 7,038,392 | B2 | 5/2006 | Libsch et al. |
| 7,057,588 | B2 | 6/2006 | Asano et al. |
| 7,061,451 | B2 | 6/2006 | Kimura |
| 7,071,932 | B2 | 7/2006 | Libsch et al. |
| 7,106,285 | B2 | 9/2006 | Naugler |
| 7,112,820 | B2 | 9/2006 | Chang et al. |
| 7,113,864 | B2 | 9/2006 | Smith et al. |
| 7,122,835 | B1 | 10/2006 | Ikeda et al. |
| 7,129,914 | B2 | 10/2006 | Knapp et al. |
| 7,164,417 | B2 | 1/2007 | Cok |
| 7,180,486 | B2 * | 2/2007 | Jeong ..... G09G 3/3233 345/76 |
| 7,224,332 | B2 | 5/2007 | Cok |
| 7,236,149 | B2 | 6/2007 | Yamashita et al. |
| 7,248,236 | B2 | 7/2007 | Nathan et al. |
| 7,259,737 | B2 | 8/2007 | Ono et al. |

(56) References Cited

U.S. PATENT DOCUMENTS 7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,466,166 B2 12/2008 Date et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.
7,688,289 B2 3/2010 Abe et al.
7,724,218 B2 5/2010 Kim et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,040,297 B2 * 10/2011 Chung ..... G09G 3/3266 315/169.3
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,319,712 B2 11/2012 Nathan et al.
8,368,619 B2 * 2/2013 Tsai ..... G09G 3/3233 345/76
8,373,696 B2 2/2013 Miyazawa
8,614,652 B2 * 12/2013 Nathan ..... G09G 3/3233 345/55
8,749,595 B2 6/2014 Nathan et al.
9,330,598 B2 * 5/2016 Nathan ..... G09G 3/3233
9,530,349 B2 * 12/2016 Chaji ..... G09G 3/3233
2001/0002703 A1 6/2001 Koyama
2001/0009283 A1 7/2001 Arao et al.
2001/0026257 A1 10/2001 Kimura
2001/0030323 A1 10/2001 Ikeda
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2003/0001828 A1 1/2003 Asano
2003/0016190 A1 1/2003 Kondo
2003/0020413 A1 1/2003 Oomura
2003/0020705 A1 * 1/2003 Kondo ..... G09G 3/3233 345/212
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0179626 A1 9/2003 Sanford et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0100427 A1 5/2004 Miyazawa
2004/0129933 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0160516 A1 8/2004 Ford
2004/0174349 A1 9/2004 Libsch et al.
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe Masashi
2004/0251844 A1 12/2004 Hashido et al.
2004/0252085 A1 12/2004 Miyagawa Keisuke
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140600 A1 6/2005 Kim
2005/0140610 A1 6/2005 Smith et al.
2005/0145891 A1 7/2005 Abe

(56) References Cited

U.S. PATENT DOCUMENTS

| | | | | |
|---|---|---|---|---|
| 2005/0156831 | A1 | 7/2005 | Yamazaki et al. | |
| 2005/0168416 | A1 | 8/2005 | Hashimoto et al. | |
| 2005/0206590 | A1 | 9/2005 | Sasaki et al. | |
| 2005/0219188 | A1 | 10/2005 | Kawabe et al. | |
| 2005/0243037 | A1 | 11/2005 | Eom et al. | |
| 2005/0248515 | A1 | 11/2005 | Naugler et al. | |
| 2005/0258867 | A1 | 11/2005 | Miyazawa | |
| 2005/0285825 | A1 | 12/2005 | Eom et al. | |
| 2006/0012311 | A1 | 1/2006 | Ogawa | |
| 2006/0038750 | A1 | 2/2006 | Inoue et al. | |
| 2006/0038758 | A1 | 2/2006 | Routley et al. | |
| 2006/0038762 | A1 | 2/2006 | Chou | |
| 2006/0066533 | A1 | 3/2006 | Sato et al. | |
| 2006/0077077 | A1 | 4/2006 | Kwon | |
| 2006/0077194 | A1* | 4/2006 | Jeong | G09G 3/3233 345/204 |
| 2006/0092185 | A1 | 5/2006 | Jo et al. | |
| 2006/0125408 | A1* | 6/2006 | Nathan | G09G 3/3233 315/169.3 |
| 2006/0139253 | A1 | 6/2006 | Choi et al. | |
| 2006/0145964 | A1 | 7/2006 | Park et al. | |
| 2006/0191178 | A1 | 8/2006 | Sempel et al. | |
| 2006/0209012 | A1 | 9/2006 | Hagood, IV | |
| 2006/0214888 | A1 | 9/2006 | Schneider et al. | |
| 2006/0221009 | A1 | 10/2006 | Miwa | |
| 2006/0227082 | A1 | 10/2006 | Ogata et al. | |
| 2006/0232522 | A1 | 10/2006 | Roy et al. | |
| 2006/0244388 | A1* | 11/2006 | Chung | G09G 3/3266 315/169.3 |
| 2006/0244391 | A1 | 11/2006 | Shishido et al. | |
| 2006/0244695 | A1 | 11/2006 | Komiya | |
| 2006/0244697 | A1 | 11/2006 | Lee et al. | |
| 2006/0248420 | A1 | 11/2006 | Jeong | |
| 2006/0261841 | A1 | 11/2006 | Fish | |
| 2006/0267885 | A1 | 11/2006 | Kwak et al. | |
| 2006/0290614 | A1 | 12/2006 | Nathan et al. | |
| 2007/0001939 | A1 | 1/2007 | Hashimoto et al. | |
| 2007/0001945 | A1 | 1/2007 | Yoshida et al. | |
| 2007/0008251 | A1 | 1/2007 | Kohno et al. | |
| 2007/0008297 | A1 | 1/2007 | Bassetti | |
| 2007/0035489 | A1 | 2/2007 | Lee | |
| 2007/0035707 | A1 | 2/2007 | Margulis | |
| 2007/0040773 | A1 | 2/2007 | Lee et al. | |
| 2007/0040782 | A1 | 2/2007 | Woo et al. | |
| 2007/0063932 | A1 | 3/2007 | Nathan et al. | |
| 2007/0080908 | A1 | 4/2007 | Nathan et al. | |
| 2007/0085801 | A1 | 4/2007 | Park et al. | |
| 2007/0109232 | A1 | 5/2007 | Yamamoto et al. | |
| 2007/0128583 | A1 | 6/2007 | Miyazawa | |
| 2007/0164941 | A1 | 7/2007 | Park et al. | |
| 2007/0182671 | A1 | 8/2007 | Nathan et al. | |
| 2007/0236430 | A1 | 10/2007 | Fish | |
| 2007/0241999 | A1 | 10/2007 | Lin | |
| 2007/0242008 | A1 | 10/2007 | Cummings | |
| 2008/0001544 | A1 | 1/2008 | Murakami et al. | |
| 2008/0043044 | A1 | 2/2008 | Woo et al. | |
| 2008/0048951 | A1 | 2/2008 | Naugler et al. | |
| 2008/0055134 | A1 | 3/2008 | Li et al. | |
| 2008/0074360 | A1 | 3/2008 | Lu et al. | |
| 2008/0088549 | A1 | 4/2008 | Nathan et al. | |
| 2008/0094426 | A1 | 4/2008 | Kimpe | |
| 2008/0122819 | A1 | 5/2008 | Cho et al. | |
| 2008/0129906 | A1 | 6/2008 | Lin et al. | |
| 2008/0170008 | A1 | 7/2008 | Kim | |
| 2008/0228562 | A1 | 9/2008 | Smith et al. | |
| 2008/0231641 | A1 | 9/2008 | Miyashita | |
| 2008/0265786 | A1 | 10/2008 | Koyama | |
| 2008/0290805 | A1 | 11/2008 | Yamada et al. | |
| 2009/0009459 | A1 | 1/2009 | Miyashita | |
| 2009/0015532 | A1 | 1/2009 | Katayama et al. | |
| 2009/0058789 | A1 | 3/2009 | Hung et al. | |
| 2009/0121988 | A1 | 5/2009 | Amo et al. | |
| 2009/0146926 | A1 | 6/2009 | Sung et al. | |
| 2009/0153448 | A1 | 6/2009 | Tomida et al. | |
| 2009/0153459 | A9 | 6/2009 | Han et al. | |
| 2009/0174628 | A1 | 7/2009 | Wang et al. | |
| 2009/0201230 | A1 | 8/2009 | Smith | |
| 2009/0201281 | A1 | 8/2009 | Routley et al. | |
| 2009/0219232 | A1 | 9/2009 | Choi | |
| 2009/0251486 | A1 | 10/2009 | Sakakibara et al. | |
| 2009/0278777 | A1 | 11/2009 | Wang et al. | |
| 2009/0289964 | A1 | 11/2009 | Miyachi | |
| 2010/0039451 | A1 | 2/2010 | Jung | |
| 2010/0039453 | A1 | 2/2010 | Chaji et al. | |
| 2010/0207920 | A1 | 8/2010 | Chaji et al. | |
| 2010/0225634 | A1 | 9/2010 | Levey et al. | |
| 2010/0251295 | A1 | 9/2010 | Amento et al. | |
| 2010/0269889 | A1 | 10/2010 | Reinhold et al. | |
| 2010/0277400 | A1 | 11/2010 | Jeong | |
| 2010/0315319 | A1 | 12/2010 | Cok et al. | |
| 2011/0050741 | A1 | 3/2011 | Jeong | |
| 2011/0069089 | A1 | 3/2011 | Kopf et al. | |
| 2012/0299976 | A1 | 11/2012 | Chen et al. | |

FOREIGN PATENT DOCUMENTS

| | | | |
|---|---|---|---|
| CA | 2 557 713 | | 11/2006 |
| CA | 2 526 782 | C | 8/2007 |
| CA | 2 651 893 | | 11/2007 |
| CA | 2 672 590 | | 10/2009 |
| CN | 1591105 | | 3/2005 |
| CN | 1758308 | A | 4/2006 |
| CN | 1886774 | | 12/2006 |
| CN | 101111880 | | 1/2008 |
| CN | 101111880 | A | 1/2008 |
| DE | 202006007613 | | 9/2006 |
| EP | 0 478 186 | | 4/1992 |
| EP | 1 028 471 | A | 8/2000 |
| EP | 1 130 565 | A1 | 9/2001 |
| EP | 1 194 013 | | 4/2002 |
| EP | 1 321 922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-271095 | | 9/2003 |
| JP | 2003-308046 | | 10/2003 |
| JP | 2004-054188 | | 2/2004 |
| JP | 2005-099715 | | 4/2005 |
| JP | 2005-338819 | | 12/2005 |
| JP | 2007-065539 | | 3/2007 |
| TW | 569173 | | 1/2004 |
| TW | 200526065 | | 8/2005 |
| TW | 1239501 | | 9/2005 |
| TW | 200717387 | A | 5/2007 |
| WO | WO 1998/11554 | | 3/1998 |
| WO | WO 1999/48079 | | 9/1999 |
| WO | WO 2001/27910 | A1 | 4/2001 |
| WO | WO 2002/067327 | A | 8/2002 |
| WO | WO 2003/034389 | | 4/2003 |
| WO | WO 03/063124 | | 7/2003 |
| WO | WO 2003/063124 | | 7/2003 |
| WO | WO 2003/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/053424 | | 5/2006 |
| WO | WO 2006/063448 | | 6/2006 |

(56) References Cited

FOREIGN PATENT DOCUMENTS

| | | |
|---|---|---|
| WO | WO 2006/128069 | 11/2006 |
| WO | WO 2009/059028 | 5/2009 |
| WO | WO 2009/127065 | 10/2009 |
| WO | WO 2010/066030 | 6/2010 |
| WO | WO 2010/120733 | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-A fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High- Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces" Keith Jack: "Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamentals and Applications" 2005 Referex ORD-0000-00-00 U.K.; XP040426102 ISBN: 0/7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 , dated Aug. 18, 2009 (12 pages).
European Search Report Application No. 10 83 4294.0/1903, dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223., 4 dated Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for AMOLDED Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 mailed Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).

(56) References Cited

OTHER PUBLICATIONS

International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCTAB2010/055481 dated Apr. 7, 2011 (6 pages).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda yet al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Perfainiance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays " Proceedings of the 9$^{th}$ Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
Office Action dated Apr. 5, 2013, in corresponding Japanese Patent Application No. 2011-504297, (w/English translation) (6 pages).
Second Office Action with Search Report, dated Jun. 9, 2013, in corresponding Chinese Patent Application No. 200980120671, (w/English translation) (12 pages).
Office Action dated Jun. 10, 2014, in corresponding Japanese Patent Application No. 2013-169044, (w/English translation) (5 pages).

* cited by examiner $$V1 = VB - \sqrt{\frac{IB}{\beta}} - VT$$

$$V1 = VB - \sqrt{\frac{IB}{\beta}} - VT$$

208

300

302

*FIG.28* An example of array structure for implementation of CBVP driving scheme.

*FIG.29* A further example of array structure for implementation of CBVP driving scheme.

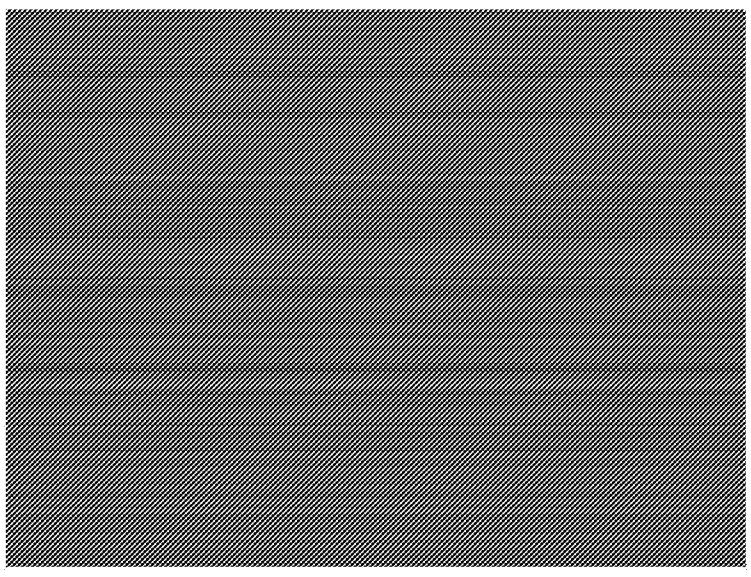
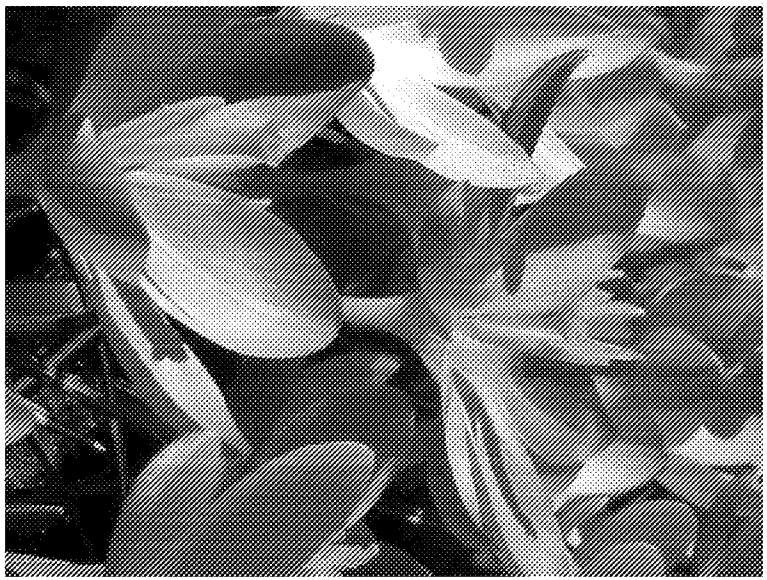
FIG.31

SYSTEM AND DRIVING METHOD FOR LIGHT EMITTING DEVICE DISPLAY

CROSS REFERENCE TO RELATED APPLICATIONS

This application is a continuation of U.S. patent application Ser. No. 14/094,175, filed Dec. 2, 2013, now allowed, which is a continuation of U.S. patent application Ser. No. 12/425,734, filed Apr. 17, 2009, now U.S. Pat. No. 8,614,652, which claims the benefit of priority to U.S. Provisional Patent Application No. 61/046,256, filed Apr. 18, 2008, all of which are hereby incorporated by reference in their entireties.

FIELD OF INVENTION

The present invention relates to a light emitting device displays, and more specifically to a driving technique for the light emitting device displays.

BACKGROUND OF THE INVENTION

Recently active-matrix organic light-emitting diode (AMOLED) displays with amorphous silicon (a-Si), polysilicon, organic, or other driving backplane technology have become more attractive due to advantages over active matrix liquid crystal displays. An AMOLED display using a-Si backplanes, for example, has the advantages which include low temperature fabrication that broadens the use of different substrates and makes flexible displays feasible, and its low cost fabrication is well-established and yields high resolution displays with a wide viewing angle.

An AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

One method that has been employed to drive the AMOLED display is programming the AMOLED pixel directly with current. However, the small current required by the OLED, coupled with a large parasitic capacitance, undesirably increases the settling time of the programming of the current-programmed AMOLED display. Furthermore, it is difficult to design an external driver to accurately supply the required current. For example, in CMOS technology, the transistors must work in sub-threshold regime to provide the small current required by the OLEDs, which is not ideal. Therefore, in order to use current-programmed AMOLED pixel circuits, suitable driving schemes are desirable.

Current scaling is one method that can be used to manage issues associated with the small current required by the OLEDs. In a current mirror pixel circuit, the current passing through the OLED can be scaled by having a smaller drive transistor as compared to the mirror transistor. However, this method is not applicable for other current-programmed pixel circuits. Also, by resizing the two mirror transistors the effect of mismatch increases.

SUMMARY OF THE INVENTION

It is an object of the invention to provide a method and system that obviates or mitigates at least one of the disadvantages of existing systems.

In accordance with an aspect of the present invention there is provided a pixel circuit, which includes a light emitting device, a driving transistor for providing a pixel current to the light emitting device; a storage capacitor provided between a data line for providing programming voltage data and the gate terminal of the driving transistor, a first switch transistor provided between the gate terminal of the driving transistor and the light emitting device, and a second switch transistor provided between the light emitting device and a bias line for providing a bias current to the first terminal of the driving transistor during a programming cycle.

In accordance with a further aspect of the present invention there is provided a pixel circuit, which includes a light emitting device, a storage capacitor, a driving transistor for providing a pixel current to the light emitting device, a plurality of first switch transistors operated by a first select line, one of the first switch transistors being provided between the storage capacitor and a data line for providing programming voltage data, a plurality of second switch transistors operated by a second select line, one of the second switch transistor being provided between the driving transistor and a bias line for providing a bias current to the first terminal of the driving transistor during a programming cycle; and an emission control circuit for setting the pixel circuit into an emission mode.

In accordance with a further aspect of the present invention there is provided a display system, which includes a pixel array having a plurality of pixel circuits, a first driver for selecting the pixel circuit, a second driver for providing the programming voltage data, and a current source for operating on the bias line.

In accordance with a further aspect of the present invention there is provided a a method of driving a pixel circuit, the pixel circuit having a driving transistor for providing a pixel current to a light emitting device, a storage capacitor coupled to a data line, and a switch transistor coupled to the gate terminal of the driving transistor and the storage capacitor. The method includes: at a programming cycle, selecting the pixel circuit, providing a bias current to a connection between the driving transistor and the light emitting device, and providing programming voltage data from the data line to the pixel circuit.

In accordance with a further aspect of the present invention there is provided a a method of driving a pixel circuit, the pixel circuit having a driving transistor for providing a pixel current to a light emitting device, a switch transistor coupled to a data line, and a storage capacitor coupled to the switch transistor and the driving transistor. The method includes: at a programming cycle, selecting the pixel circuit, providing a bias current to a first terminal of the driving transistor, and providing programming voltage data from the data line to a first terminal of the storage capacitor, the second terminal of the storage capacitor being coupled to the first terminal of the driving transistor, a second terminal of the driving transistor being coupled to the light emitting device; and at a driving cycle, setting an emission mode in the pixel circuit.

This summary of the invention does not necessarily describe all features of the invention.

Other aspects and features of the present invention will be readily apparent to those skilled in the art from a review of the following detailed description of preferred embodiments in conjunction with the accompanying drawings.

BRIEF DESCRIPTION OF THE DRAWINGS

These and other features of the invention will become more apparent from the following description in which reference is made to the appended drawings wherein:

FIG. 31 is a photograph showing effect of spatial mismatches on a display using the voltage-programmed circuits.

DETAILED DESCRIPTION OF THE PREFERRED EMBODIMENTS OF THE INVENTION

Embodiments of the present invention are described using a pixel having an organic light emitting diode (OLED) and a driving thin film transistor (TFT). However, the pixel may include any light emitting device other than OLED, and the pixel may include any driving transistor other than TFT. It is noted that in the description, "pixel circuit" and "pixel" may be used interchangeably.

A driving technique for pixels, including a current-biased voltage-programmed (CBVP) driving scheme, is now described in detail. The CBVP driving scheme uses voltage to provide for different gray scales (voltage programming), and uses a bias to accelerate the programming and compensate for the time dependent parameters of a pixel, such as a threshold voltage shift and OLED voltage shift.

Figure 1:
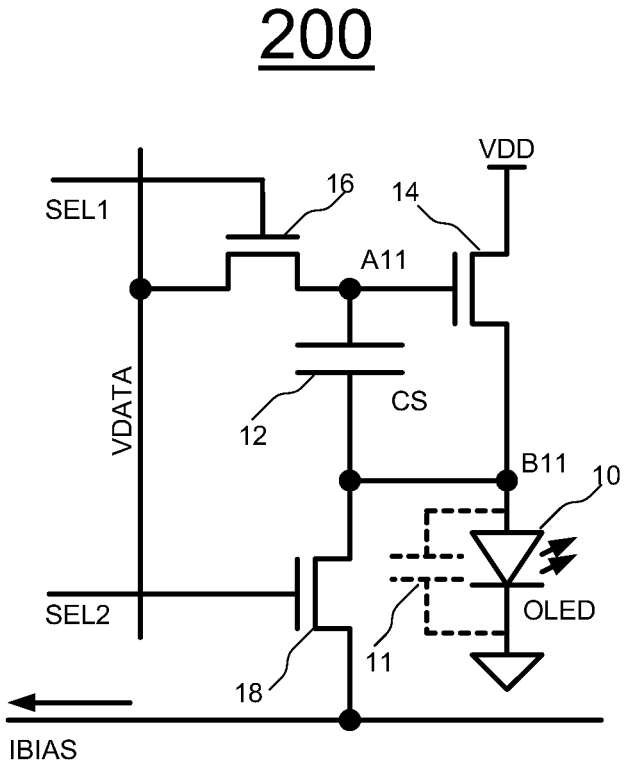
FIG. 1 is a diagram showing a pixel circuit in accordance with an embodiment of the present invention.

FIG. 1 illustrates a pixel circuit 200 in accordance with an embodiment of the present invention. The pixel circuit 200 employs the CBVP driving scheme as described below. The pixel circuit 200 of FIG. 1 includes an OLED 10, a storage capacitor 12, a driving transistor 14, and switch transistors 16 and 18. Each transistor has a gate terminal, a first terminal and a second terminal. In the description, "first terminal" ("second terminal") may be, but not limited to, a drain terminal or a source terminal (source terminal or drain terminal).

Figure 5:
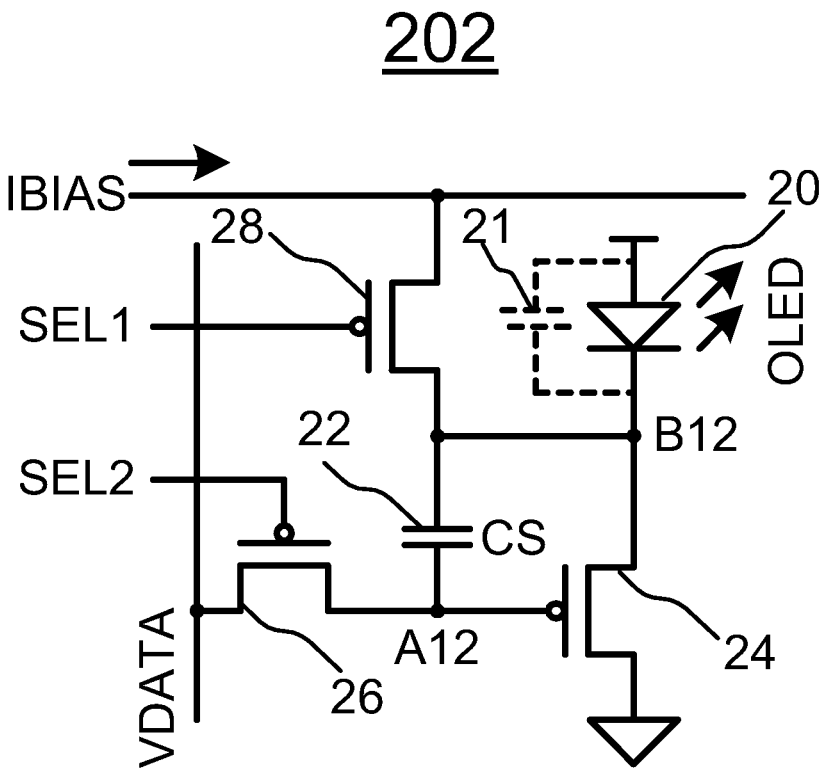
FIG. 5 is a diagram showing a pixel circuit which has p-type transistors and corresponds to the pixel circuit of FIG. 1.

The transistors 14, 16 and 18 are n-type TFT transistors. The driving technique applied to the pixel circuit 200 is also applicable to a complementary pixel circuit having p-type transistors as shown in FIG. 5.

The transistors 14, 16 and 18 may be fabricated using amorphous silicon, nano/micro crystalline silicon, poly silicon, organic semiconductors technologies (e.g. organic TETs), NMOS technology, or CMOS technology (e.g. MOSFET). A plurality of pixel circuits 200 may form an AMOLED display array.

Two select lines SEL1 and SEL2, a signal line VDATA, a bias line IBIAS, a voltage supply line VDD, and a common ground are provided to the pixel circuit 200. In FIG. 1, the common ground is for the OLED top electrode. The common ground is not a part of the pixel circuit, and is formed at the final stage when the OLED 10 is formed.

The first terminal of the driving transistor 14 is connected to the voltage supply line VDD. The second terminal of the driving transistor 14 is connected to the anode electrode of the OLED 10. The gate terminal of the driving transistor 14 is connected to the signal line VDATA through the switch transistor 16. The storage capacitor 12 is connected between the second and gate terminals of the driving transistor 14.

The gate terminal of the switch transistor 16 is connected to the first select line SEL1. The first terminal of the switch transistor 16 is connected to the signal line VDATA. The second terminal of the switch transistor 16 is connected to the gate terminal of the driving transistor 14.

The gate terminal of the switch transistor 18 is connected to the second select line SEL2. The first terminal of transistor 18 is connected to the anode electrode of the OLED 10 and the storage capacitor 12. The second terminal of the switch transistor 18 is connected to the bias line IBIAS. The cathode electrode of the OLED 10 is connected to the common ground.

The transistors 14 and 16 and the storage capacitor 12 are connected to node A11. The OLED 10, the storage capacitor 12 and the transistors 14 and 18 are connected to B11.

The operation of the pixel circuit 200 includes a programming phase having a plurality of programming cycles, and a driving phase having one driving cycle. During the programming phase, node B11 is charged to negative of the threshold voltage of the driving transistor 14, and node A11 is charged to a programming voltage VP.

As a result, the gate-source voltage of the driving transistor 14 is:

$$VGS=VP-(-VT)=VP+VT \tag{1}$$

where VGS represents the gate-source voltage of the driving transistor 14, and VT represents the threshold voltage of the driving transistor 14. This voltage remains on the capacitor 12 in the driving phase, resulting in the flow of the desired current through the OLED 10 in the driving phase.

Figure 2:
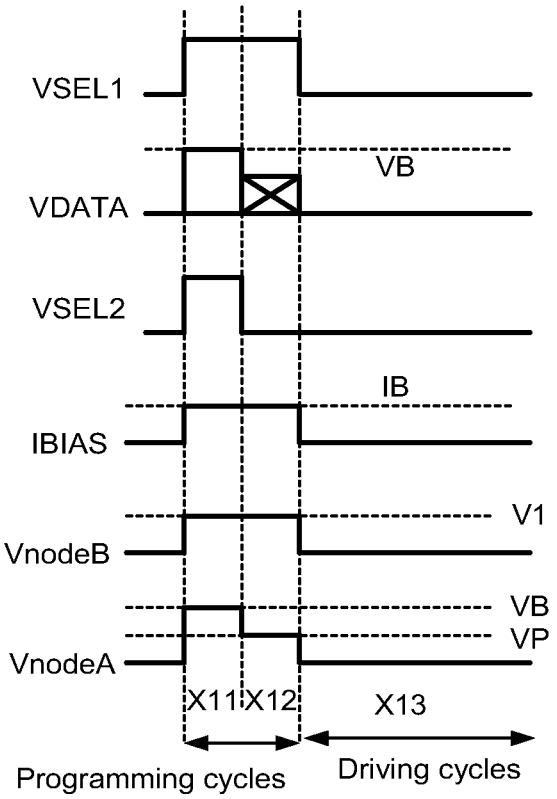
FIG. 2 is a timing diagram showing exemplary waveforms applied to the pixel circuit of FIG. 1.

The programming and driving phases of the pixel circuit 200 are described in detail. FIG. 2 illustrates one exemplary operation process applied to the pixel circuit 200 of FIG. 1. In FIG. 2, VnodeB represents the voltage of node B11, and VnodeA represents the voltage of node A11. As shown in FIG. 2, the programming phase has two operation cycles X11, X12, and the driving phase has one operation cycle X13.

The first operation cycle X11: Both select lines SEL1 and SEL2 are high. A bias current IB flows through the bias line IBIAS, and VDATA goes to a bias voltage VB.

As a result, the voltage of node B11 is:

$$VnodeB = VB - \sqrt{\frac{IB}{\beta}} - VT \tag{2}$$

where VnodeB represents the voltage of node B11, VT represents the threshold voltage of the driving transistor 14, and β represents the coefficient in current-voltage (I-V) characteristics of the TFT given by $IDS=\beta\,(VGS-VT)^2$. IDS represents the drain-source current of the driving transistor 14.

The second operation cycle X12: While SEL2 is low, and SEL1 is high, VDATA goes to a programming voltage VP. Because the capacitance 11 of the OLED 20 is large, the voltage of node B11 generated in the previous cycle stays intact.

Therefore, the gate-source voltage of the driving transistor 14 can be found as:

$$VGS = VP + \Delta VB + VT \tag{3}$$

$$\Delta VB = \sqrt{\frac{IB}{\beta}} - VB \tag{4}$$

ΔVB is zero when VB is chosen properly based on (4). The gate-source voltage of the driving transistor 14, i.e., VP+VT, is stored in the storage capacitor 12.

The third operation cycle X13: IBIAS goes to low. SEL1 goes to zero. The voltage stored in the storage capacitor 12 is applied to the gate terminal of the driving transistor 14. The driving transistor 14 is on. The gate-source voltage of the driving transistor 14 develops over the voltage stored in the storage capacitor 12. Thus, the current through the OLED 10 becomes independent of the shifts of the threshold voltage of the driving transistor 14 and OLED characteristics.

Figure 3:
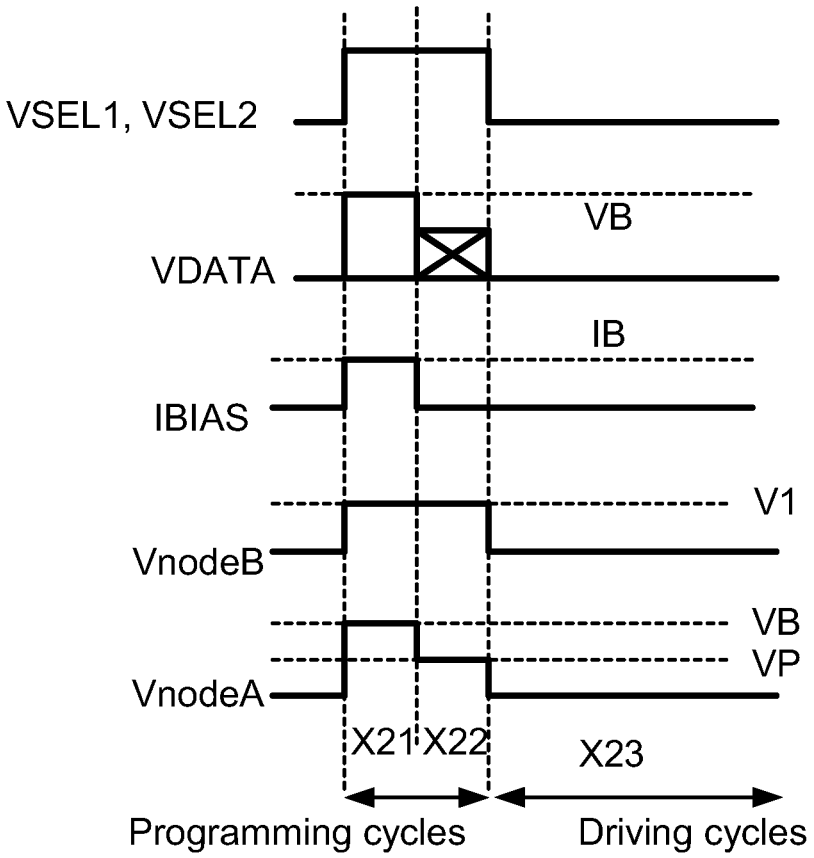
FIG. 3 is a timing diagram showing further exemplary waveforms applied to the pixel circuit of FIG. 1.

FIG. 3 illustrates a further exemplary operation process applied to the pixel circuit 200 of FIG. 1. In FIG. 3, VnodeB represents the voltage of node B11, and VnodeA represents the voltage of node A11.

The programming phase has two operation cycles X21, X22, and the driving phase has one operation cycle X23. The first operation cycle X21 is same as the first operation cycle X11 of FIG. 2. The third operation cycle X33 is same as the third operation cycle X13 of FIG. 2. In FIG. 3, the select lines SEL1 and SEL2 have the same timing. Thus, SEL1 and SEL2 may be connected to a common select line.

The second operating cycle X22: SEL1 and SEL2 are high. The switch transistor 18 is on. The bias current IB flowing through IBIAS is zero.

The gate-source voltage of the driving transistor 14 can be VGS=VP+VT as described above. The gate-source voltage of the driving transistor 14, i.e., VP+VT, is stored in the storage capacitor 12.

Figure 4:
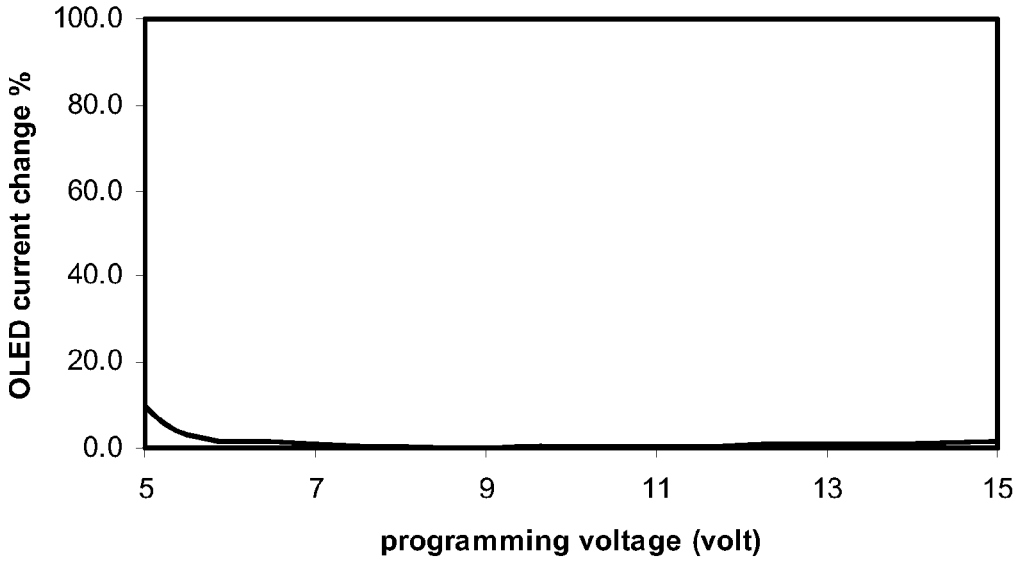
FIG. 4 is a graph showing a current stability of the pixel circuit of FIG. 1.

FIG. 4 illustrates a simulation result for the pixel circuit 200 of FIG. 1 and the waveforms of FIG. 2. The result shows that the change in the OLED current due to a 2-volt VT-shift in the driving transistor (e.g. 14 of FIG. 1) is almost zero percent for most of the programming voltage. Simulation parameters, such as threshold voltage, show that the shift has a high percentage at low programming voltage.

Figure 6:
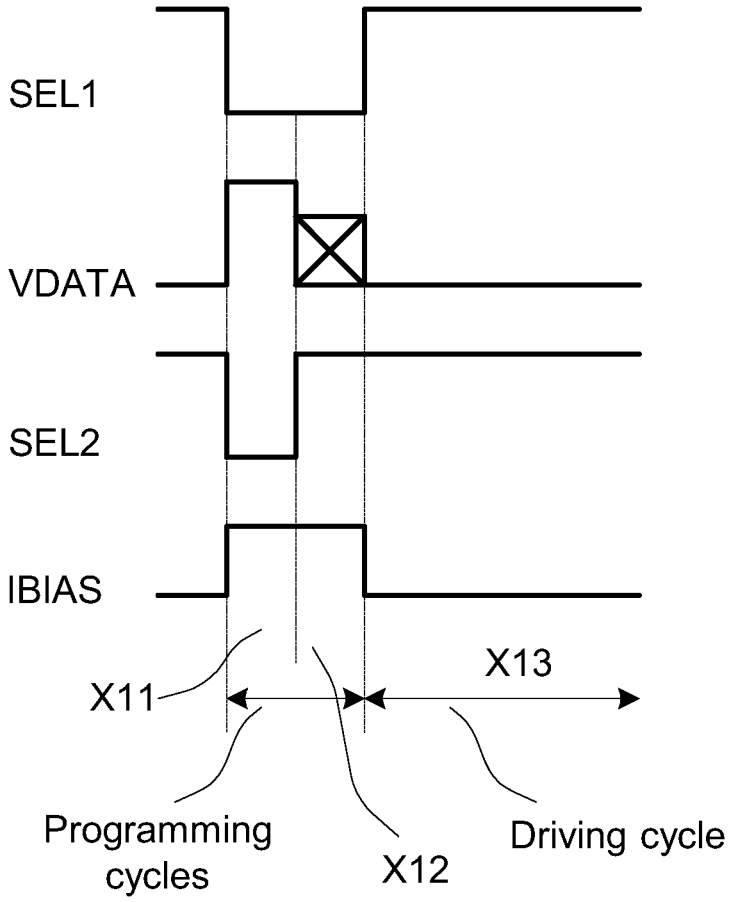
FIG. 6 is a timing diagram showing exemplary waveforms applied to the pixel circuit of FIG. 5.
Figure 7:
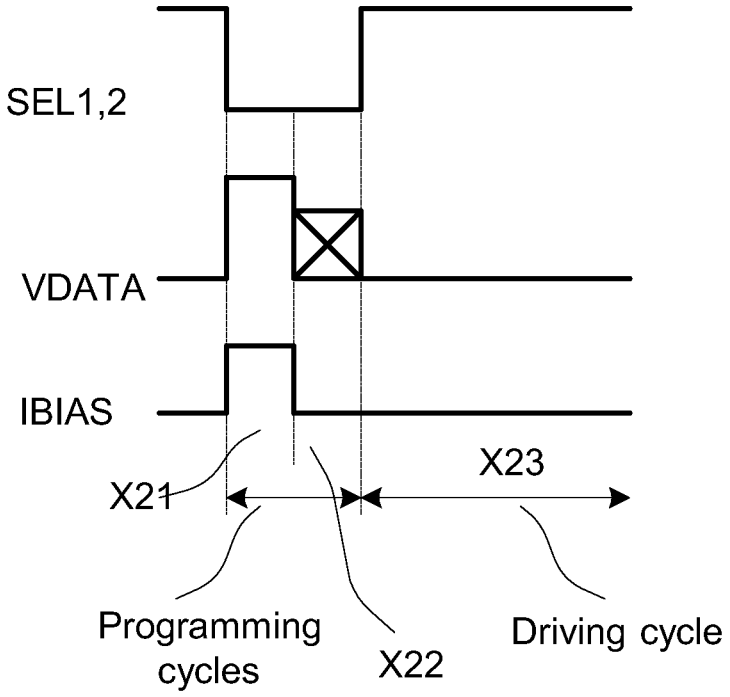
FIG. 7 is a timing diagram showing further exemplary waveforms applied to the pixel circuit of FIG. 5.

FIG. 5 illustrates a pixel circuit 202 having p-type transistors. The pixel circuit 202 corresponds to the pixel circuit 200 of FIG. 1. The pixel circuit 202 employs the CBVP driving scheme as shown in FIGS. 6-7. The pixel circuit 202 includes an OLED 20, a storage capacitor 22, a driving transistor 24, and switch transistors 26 and 28. The transistors 24, 26 and 28 are p-type transistors. Each transistor has a gate terminal, a first terminal and a second terminal.

The transistors 24, 26 and 28 may be fabricated using amorphous silicon, nano/micro crystalline silicon, poly silicon, organic semiconductors technologies (e.g. organic TFTs), PMOS technology, or CMOS technology (e.g. MOSFET). A plurality of pixel circuits 202 may form an AMOLED display array.

Two select lines SEL1 and SEL2, a signal line VDATA, a bias line IBIAS, a voltage supply line VDD, and a common ground are provided to the pixel circuit 202.

The transistors 24 and 26 and the storage capacitor 22 are connected to node A12. The cathode electrode of the OLED 20, the storage capacitor 22 and the transistors 24 and 28 are connected to B12. Since the OLED cathode is connected to the other elements of the pixel circuit 202, this ensures integration with any OLED fabrication.

FIG. 6 illustrates one exemplary operation process applied to the pixel circuit 202 of FIG. 5. FIG. 6 corresponds to FIG. 2. FIG. 7 illustrates a further exemplary operation process applied to the pixel circuit 202 of FIG. 5. FIG. 7 corresponds to FIG. 3. The CBVP driving schemes of FIGS. 6-7 use IBIAS and VDATA similar to those of FIGS. 2-3.

Figure 8:
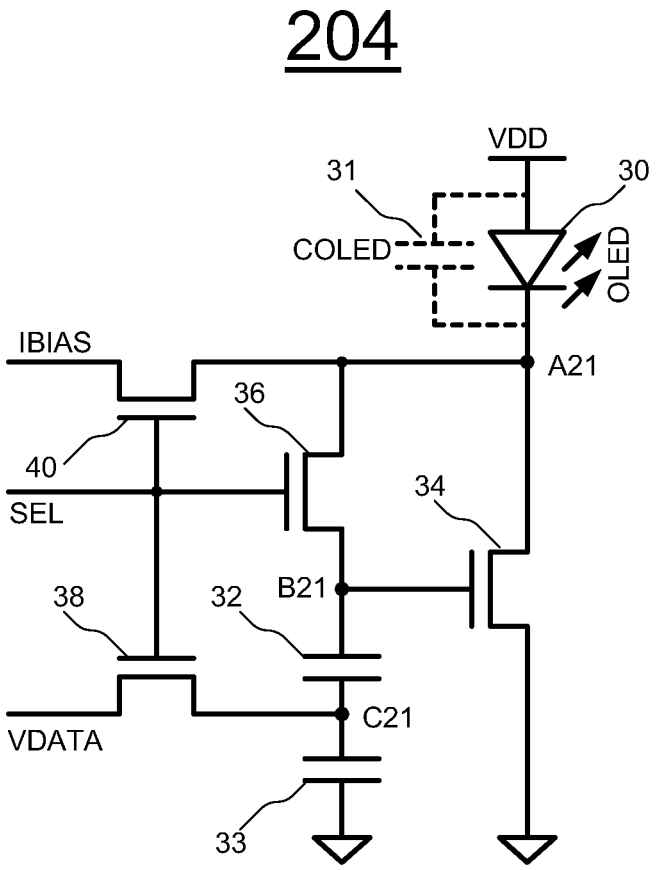
FIG. 8 is a diagram showing a pixel circuit in accordance with a further embodiment of the present invention.

FIG. 8 illustrates a pixel circuit 204 in accordance with an embodiment of the present invention. The pixel circuit 204 employs the CBVP driving scheme as described below. The pixel circuit 204 of FIG. 8 includes an OLED 30, storage capacitors 32 and 33, a driving transistor 34, and switch transistors 36, 38 and 40. Each of the transistors 34, 35 and 36 includes a gate terminal, a first terminal and a second terminal. This pixel circuit 204 operates in the same way as that of the pixel circuit 200.

Figure 10:
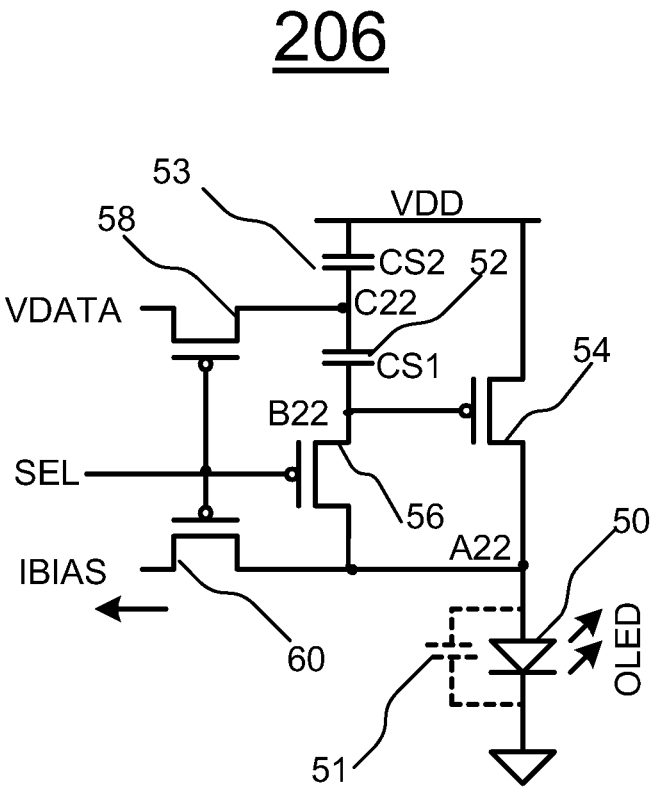
FIG. 10 is a diagram showing a pixel circuit which has p-type transistors and corresponds to the pixel circuit of FIG. 8.

The transistors 34, 36, 38 and 40 are n-type TFT transistors. The driving technique applied to the pixel circuit 204 is also applicable to a complementary pixel circuit having p-type transistors, as shown in FIG. 10.

The transistors 34, 36, 38 and 40 may be fabricated using amorphous silicon, nano/micro crystalline silicon, poly silicon, organic semiconductors technologies (e.g. organic TFTs), NMOS technology, or CMOS technology (e.g. MOSFET). A plurality of pixel circuits 204 may form an AMOLED display array.

A select line SEL, a signal line VDATA, a bias line IBIAS, a voltage line VDD, and a common ground are provided to the pixel circuit 204.

The first terminal of the driving transistor 34 is connected to the cathode electrode of the OLED 30. The second terminal of the driving transistor 34 is connected to the ground. The gate terminal of the driving transistor 34 is connected to its first terminal through the switch transistor 36. The storage capacitors 32 and 33 are in series and connected between the gate of the driving transistor 34 and the ground.

The gate terminal of the switch transistor 36 is connected to the select line SEL. The first terminal of the switch transistor 36 is connected to the first terminal of the driving transistor 34. The second terminal of the switch transistor 36 is connected to the gate terminal of the driving transistor 34.

The gate terminal of the switch transistor 38 is connected to the select line SEL. The first terminal of the switch transistor 38 is connected to the signal line VDATA. The second terminal of the switch transistor 38 is connected to the connected terminal of the storage capacitors 32 and 33 (i.e. node C21).

The gate terminal of the switch transistor 40 is connected to the select line SEL. The first terminal of the switch transistor 40 is connected to the bias line IBIAS. The second terminal of the switch transistor 40 is connected to the cathode terminal of the OLED 30. The anode electrode of the OLED 30 is connected to the VDD.

The OLED 30, the transistors 34, 36 and 40 are connected at node A21. The storage capacitor 32 and the transistors 34 and 36 are connected at node B21.

The operation of the pixel circuit 204 includes a programming phase having a plurality of programming cycles, and a driving phase having one driving cycle. During the programming phase, the first storage capacitor 32 is charged to a programming voltage VP plus the threshold voltage of the driving transistor 34, and the second storage capacitor 33 is charged to zero As a result, the gate-source voltage of the driving transistor 34 is:

$$VGS=VP+VT \tag{5}$$

where VGS represents the gate-source voltage of the driving transistor 34, and VT represents the threshold voltage of the driving transistor 34.

Figure 9:
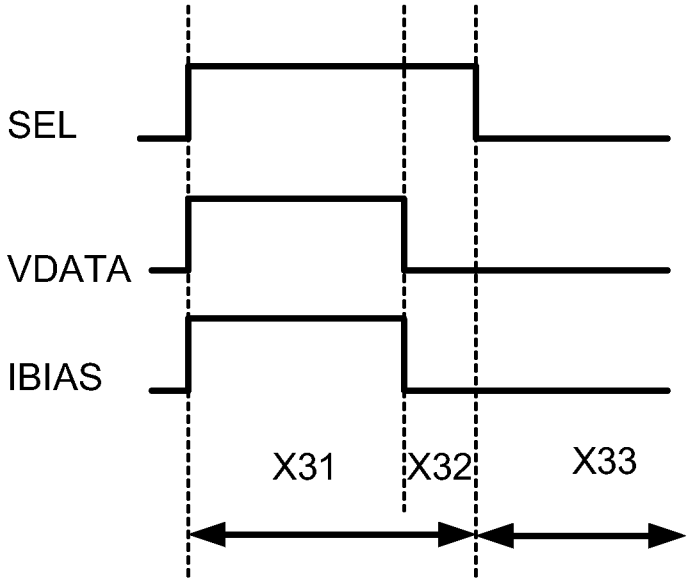
FIG. 9 is a timing diagram showing exemplary waveforms applied to the pixel circuit of FIG. 8.

The programming and driving phases of the pixel circuit 204 are described in detail. FIG. 9 illustrates one exemplary operation process applied to the pixel circuit 204 of FIG. 8. As shown in FIG. 9, the programming phase has two operation cycles X31, X32, and the driving phase has one operation cycle X33.

The first operation cycle X31: The select line SEL is high. A bias current IB flows through the bias line IBIAS, and VDATA goes to a VB-VP where VP is and programming voltage and VB is given by:

$$VB=\sqrt{\frac{IB}{\beta}} \tag{6}$$

As a result, the voltage stored in the first capacitor 32 is:

$$VC1=VP+VT \tag{7}$$

where VC1 represents the voltage stored in the first storage capacitor 32, VT represents the threshold voltage of the driving transistor 34, β represents the coefficient in current-voltage (I-V) characteristics of the TFT given by $IDS=\beta(VGS-VT)^2$. IDS represents the drain-source current of the driving transistor 34.

The second operation cycle: While SEL is high, VDATA is zero, and IBIAS goes to zero. Because the capacitance 31 of the OLED 30 and the parasitic capacitance of the bias line IBIAS are large, the voltage of node B21 and the voltage of node A21 generated in the previous cycle stay unchanged.

Therefore, the gate-source voltage of the driving transistor 34 can be found as:

$$VGS=VP+VT \tag{8}$$

where VGS represents the gate-source voltage of the driving transistor 34.

The gate-source voltage of the driving transistor 34 is stored in the storage capacitor 32.

The third operation cycle X33: IBIAS goes to zero. SEL goes to zero. The voltage of node C21 goes to zero. The voltage stored in the storage capacitor 32 is applied to the gate terminal of the driving transistor 34. The gate-source voltage of the driving transistor 34 develops over the voltage stored in the storage capacitor 32. Considering that the current of driving transistor 34 is mainly defined by its gate-source voltage, the current through the OLED 30 becomes independent of the shifts of the threshold voltage of the driving transistor 34 and OLED characteristics.

Figure 11:
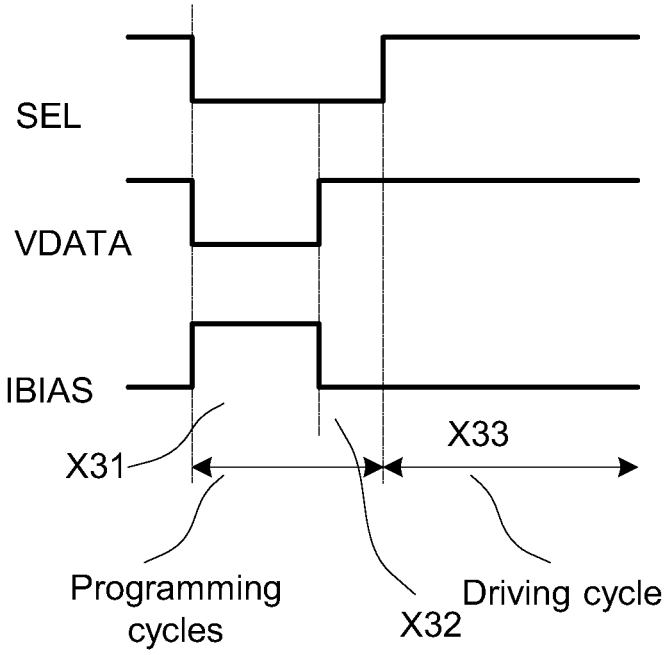
FIG. 11 is a timing diagram showing exemplary waveforms applied to the pixel circuit of FIG. 10.

FIG. 10 illustrates a pixel circuit 206 having p-type transistors. The pixel circuit 206 corresponds to the pixel circuit 204 of FIG. 8. The pixel circuit 206 employs the CBVP driving scheme as shown in FIG. 11. The pixel circuit 206 of FIG. 10 includes an OLED 50, a storage capacitors 52 and 53, a driving transistor 54, and switch transistors 56, 58 and 60. The transistors 54, 56, 58 and 60 are p-type transistors. Each transistor has a gate terminal, a first terminal and a second terminal.

The transistors 54, 56, 58 and 60 may be fabricated using amorphous silicon, nano/micro crystalline silicon, poly silicon, organic semiconductors technologies (e.g. organic TFTs), PMOS technology, or CMOS technology (e.g. MOSFET). A plurality of pixel circuits 206 may form an AMOLED display array.

Two select lines SEL1 and SEL2, a signal line VDATA, a bias line IBIAS, a voltage supply line VDD, and a common ground are provided to the pixel circuit 206. The common ground may be same as that of FIG. 1.

The anode electrode of the OLED 50, the transistors 54, 56 and 60 are connected at node A22. The storage capacitor 52 and the transistors 54 and 56 are connected at node B22. The switch transistor 58, and the storage capacitors 52 and 53 are connected at node C22.

FIG. 11 illustrates one exemplary operation process applied to the pixel circuit 206 of FIG. 10. FIG. 11 corresponds to FIG. 9. As shown in FIG. 11, the CBVP driving scheme of FIG. 11 uses IBIAS and VDATA similar to those of FIG. 9.

Figure 12:
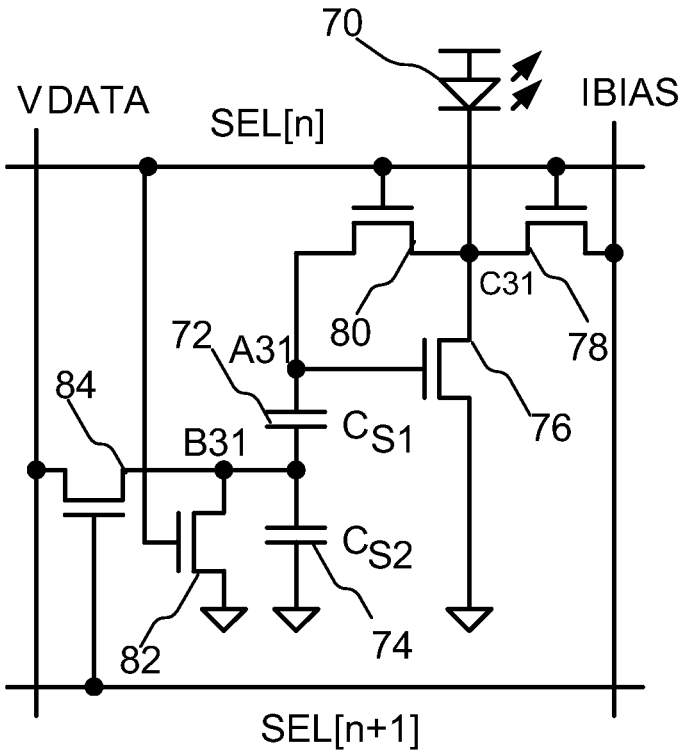
FIG. 12 is a diagram showing a pixel circuit in accordance with an embodiment of the present invention.

FIG. 12 illustrates a display 208 in accordance with an embodiment of the present invention. The display 208 employs the CBVP driving scheme as described below. In FIG. 12, elements associated with two rows and one column are shown as example. The display 208 may include more than two rows and more than one column.

The display 208 includes an OLED 70, storage capacitors 72 and 73, transistors 76, 78, 80, 82 and 84. The transistor 76 is a driving transistor. The transistors 78, 80 and 84 are switch transistors. Each of the transistors 76, 78, 80, 82 and 84 includes a gate terminal, a first terminal and a second terminal.

Figure 16:
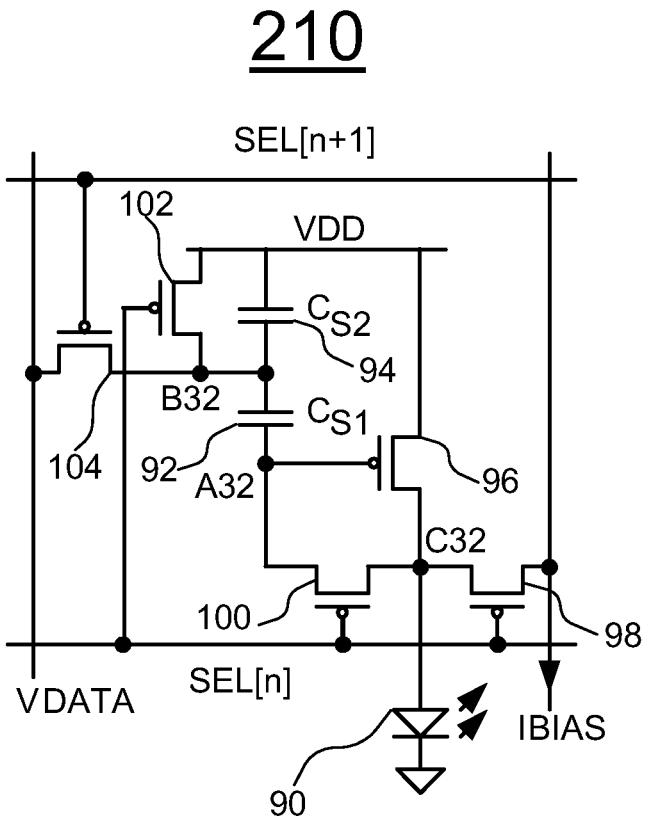
FIG. 16 is a diagram showing a pixel circuit which has p-type transistors and corresponds to the pixel circuit of FIG. 12.

The transistors 76, 78, 80, 82 and 84 are n-type TFT transistors. The driving technique applied to the pixel circuit 208 is also applicable to a complementary pixel circuit having p-type transistors, as shown in FIG. 16.

The transistors 76, 78, 80, 82 and 84 may be fabricated using amorphous silicon, nano/micro crystalline silicon, poly silicon, organic semiconductors technologies (e.g. organic TFTs), NMOS technology, or CMOS technology (e.g. MOSFET). The display 208 may form an AMOLED display array. The combination of the CBVP driving scheme and the display 208 provides a large-area, high-resolution AMOLED display.

The transistors 76 and 80 and the storage capacitor 72 are connected at node A31. The transistors 82 and 84 and the storage capacitors 72 and 74 are connected at B31.

Figure 13:
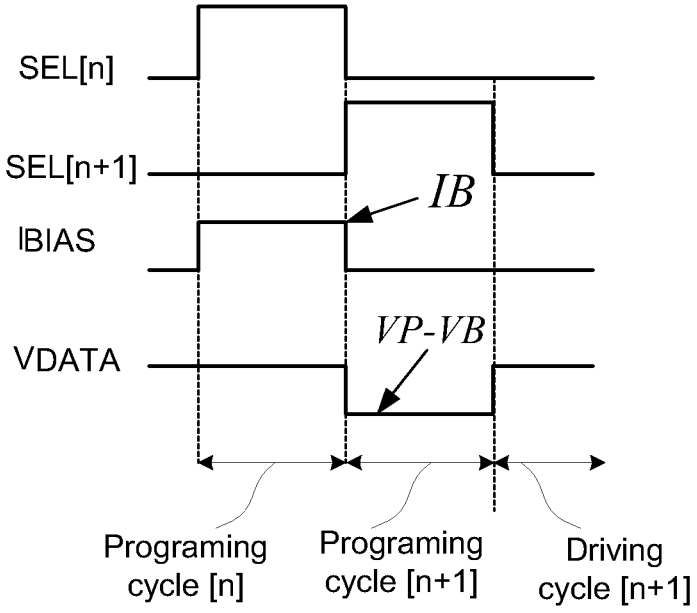
FIG. 13 is a timing diagram showing exemplary waveforms applied to the display of FIG. 12.

FIG. 13 illustrates one exemplary operation process applied to the display 208 of FIG. 12. In FIG. 13, "Programming cycle [n]" represents a programming cycle for the row [n] of the display 208.

The programming time is shared between two consecutive rows (n and n+1). During the programming cycle of the nth row, SEL[n] is high, and a bias current IB is flowing through the transistors 78 and 80. The voltage at node A31 is self-adjusted to $(IB/\beta)^{1/2}+VT$, while the voltage at node B31 is zero, where VT represents the threshold voltage of the driving transistor 76, and β represents the coefficient in current-voltage (I-V) characteristics of the TFT given by $IDS=\beta(VGS-VT)^2$, and IDS represents the drain-source current of the driving transistor 76.

During the programming cycle of the (n+1)th row, VDATA changes to VP−VB. As a result, the voltage at node A31 changes to VP+VT if $VB=(IB/\beta)^{1/2}$. Since a constant current is adopted for all the pixels, the IBIAS line consistently has the appropriate voltage so that there is no necessity to pre-charge the line, resulting in shorter programming time and lower power consumption. More importantly, the voltage of node B31 changes from VP−VB to zero at the beginning of the programming cycle of the nth row. Therefore, the voltage at node A31 changes to $(IB/\beta)^{1/2}+VT$, and it is already adjusted to its final value, leading to a fast settling time.

Figure 14:
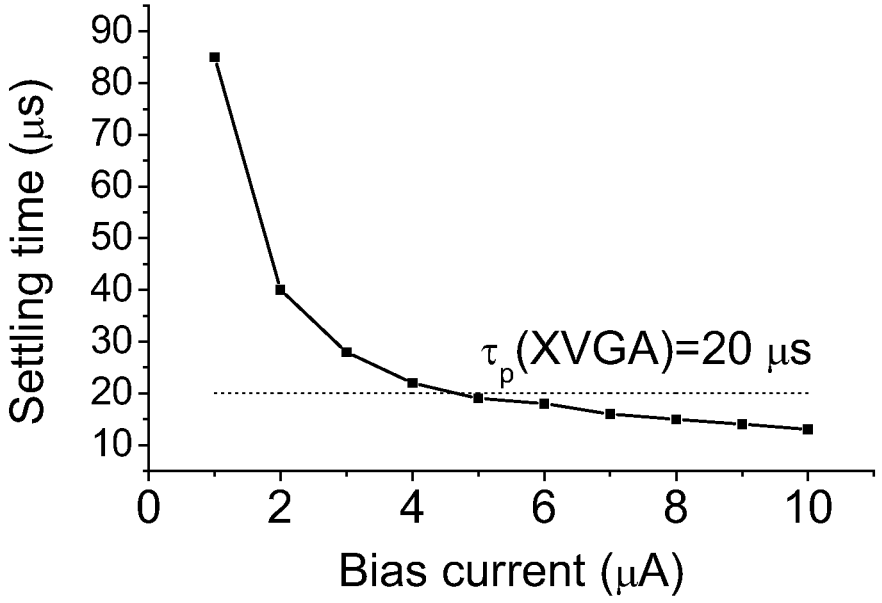
FIG. 14 is a graph showing the settling time of a CBVP pixel circuit for different bias currents.

The settling time of the CBVP pixel circuit is depicted in FIG. 14 for different bias currents. A small current can be used as IB here, resulting in lower power consumption.

Figure 15:
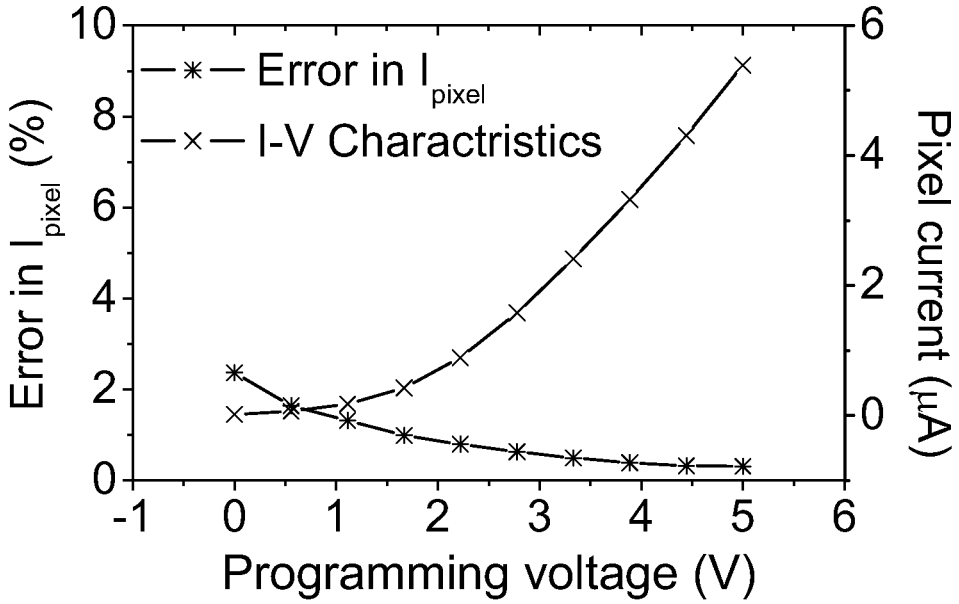
FIG. 15 is a graph showing I-V characteristic of the CBVP pixel circuit as well as the total error induced in the pixel current.

FIG. 15 illustrates I-V characteristic of the CBVP pixel circuit as well as the total error induced in the pixel current due to a 2-V shift in the threshold voltage of a driving transistor (e.g. 76 of FIG. 12). The result indicates the total error of less than 2% in the pixel current. It is noted that IB=4.5 μA.

Figure 17:
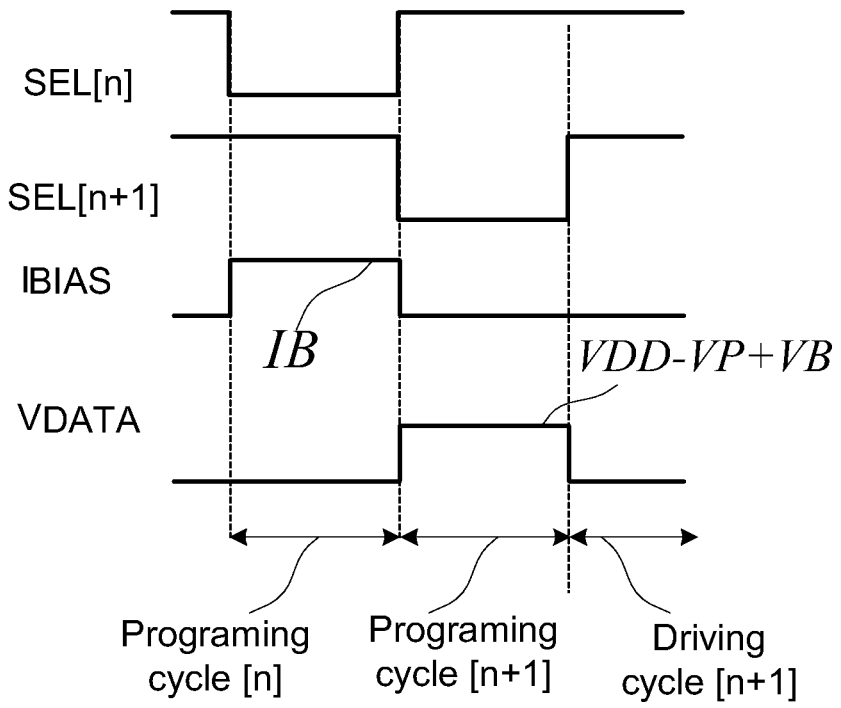
FIG. 17 is a timing diagram showing exemplary waveforms applied to the display of FIG. 16.

FIG. 16 illustrates a display 210 having p-type transistors. The display 210 corresponds to the display 208 of FIG. 12. The display 210 employs the CBVP driving scheme as shown in FIG. 17. In FIG. 12, elements associated with two rows and one column are shown as example. The display 210 may include more than two rows and more than one column.

The display 210 includes an OLED 90, a storage capacitors 92 and 94, and transistors 96, 98, 100, 102 and 104. The transistor 96 is a driving transistor. The transistors 100 and 104 are switch transistors. The transistors 24, 26 and 28 are p-type transistors. Each transistor has a gate terminal, a first terminal and a second terminal.

The transistors 96, 98, 100, 102 and 104 may be fabricated using amorphous silicon, nano/micro crystalline silicon, poly silicon, organic semiconductors technologies (e.g. organic TFTs), PMOS technology, or CMOS technology (e.g. MOSFET). The display 210 may form an AMOLED display array.

In FIG. 16, the driving transistor 96 is connected between the anode electrode of the OLED 90 and a voltage supply line VDD.

FIG. 17 illustrates one exemplary operation process applied to the display 210 of FIG. 16. FIG. 17 corresponds to FIG. 13. The CBVP driving scheme of FIG. 17 uses IBIAS and VDATA similar to those of FIG. 13.

According to the CBVP driving scheme, the overdrive voltage provided to the driving transistor is generated so as to be independent from its threshold voltage and the OLED voltage.

The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits.

Since the settling time of the pixel circuits described above is much smaller than conventional pixel circuits, it is suitable for large-area display such as high definition TV, but it also does not preclude smaller display areas either.

It is noted that a driver for driving a display array having a CBVP pixel circuit (e.g. 200, 202 or 204) converts the pixel luminance data into voltage.

A driving technique for pixels, including voltage-biased current-programmed (VBCP) driving scheme is now described in detail. In the VBCP driving scheme, a pixel current is scaled down without resizing mirror transistors. The VBCP driving scheme uses current to provide for different gray scales (current programming), and uses a bias to accelerate the programming and compensate for a time dependent parameter of a pixel, such as a threshold voltage shift. One of the terminals of a driving transistor is connected to a virtual ground VGND. By changing the voltage of the virtual ground, the pixel current is changed. A bias current IB is added to a programming current IP at a driver side, and then the bias current is removed from the programming current inside the pixel circuit by changing the voltage of the virtual ground.

Figure 18:
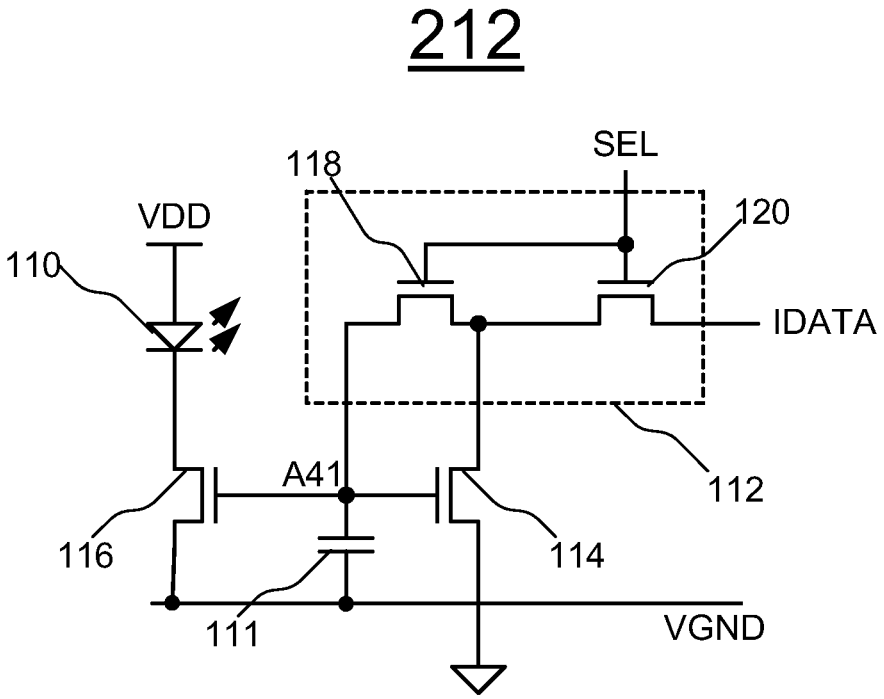
FIG. 18 is a diagram showing a VBCP pixel circuit in accordance with a further embodiment of the present invention.

FIG. 18 illustrates a pixel circuit 212 in accordance with a further embodiment of the present invention. The pixel circuit 212 employs the VBCP driving scheme as described below. The pixel circuit 212 of FIG. 18 includes an OLED 110, a storage capacitor 111, a switch network 112, and mirror transistors 114 and 116. The mirror transistors 114 and 116 form a current mirror. The transistor 114 is a programming transistor. The transistor 116 is a driving transistor. The switch network 112 includes switch transistors 118 and 120. Each of the transistors 114, 116, 118 and 120 has a gate terminal, a first terminal and a second terminal.

Figure 20:
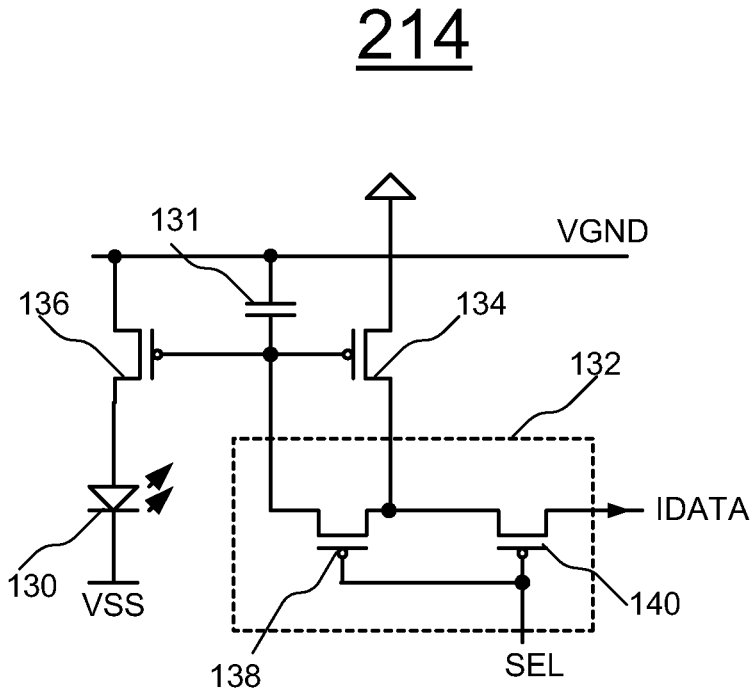
FIG. 20 is a diagram showing a VBCP pixel circuit which has p-type transistors and corresponds to the pixel circuit of FIG. 18.

The transistors 114, 116, 118 and 120 are n-type TFT transistors. The driving technique applied to the pixel circuit 212 is also applicable to a complementary pixel circuit having p-type transistors as shown in FIG. 20.

The transistors 114, 116, 118 and 120 may be fabricated using amorphous silicon, nano/micro crystalline silicon, poly silicon, organic semiconductors technologies (e.g. organic TFTs), NMOS technology, or CMOS technology (e.g. MOSFET). A plurality of pixel circuits 212 may form an AMOLED display array.

A select line SEL, a signal line IDATA, a virtual grand line VGND, a voltage supply line VDD, and a common ground are provided to the pixel circuit 150.

The first terminal of the transistor 116 is connected to the cathode electrode of the OLED 110. The second terminal of the transistor 116 is connected to the VGND. The gate terminal of the transistor 114, the gate terminal of the transistor 116, and the storage capacitor 111 are connected to a connection node A41.

The gate terminals of the switch transistors 118 and 120 are connected to the SEL. The first terminal of the switch transistor 120 is connected to the IDATA. The switch transistors 118 and 120 are connected to the first terminal of the transistor 114. The switch transistor 118 is connected to node A41.

Figure 19:
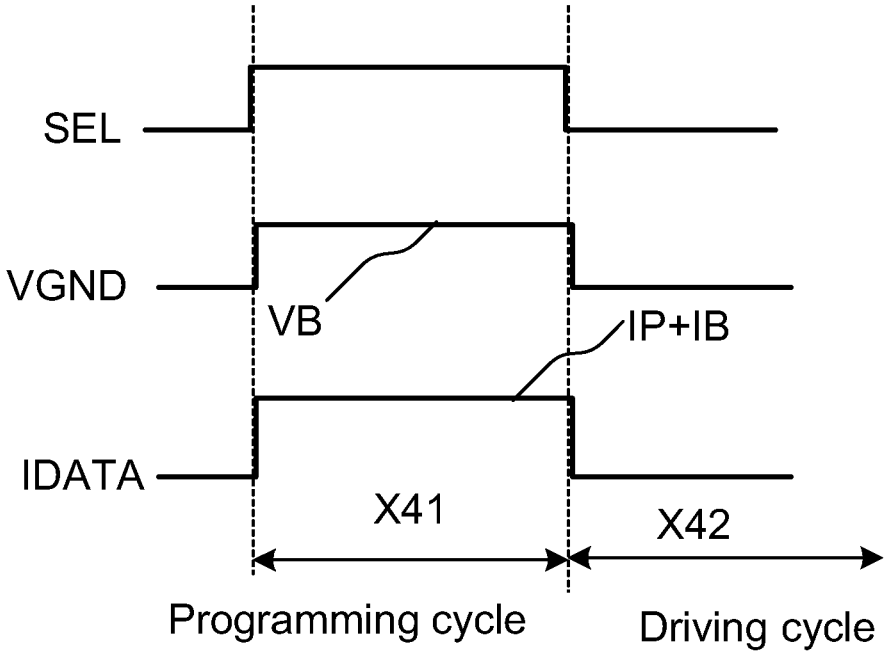
FIG. 19 is a timing diagram showing exemplary waveforms applied to the pixel circuit of FIG. 18.

FIG. 19 illustrates an exemplary operation for the pixel circuit 212 of FIG. 18. Referring to FIGS. 18 and 19, current scaling technique applied to the pixel circuit 212 is described in detail. The operation of the pixel circuit 212 has a programming cycle X41, and a driving cycle X42.

The programming cycle X41: SEL is high. Thus, the switch transistors 118 and 120 are on. The VGND goes to a bias voltage VB. A current (IB+IP) is provided through the IDATA, where IP represents a programming current, and LB represents a bias current. A current equal to (IB+IP) passes through the switch transistors 118 and 120.

The gate-source voltage of the driving transistor 116 is self-adjusted to:

$$VGS = \sqrt{\frac{IP + IB}{\beta}} + VT \tag{9}$$

where VT represents the threshold voltage of the driving transistor 116, and β represents the coefficient in current-voltage (I-V) characteristics of the TFT given by IDS=β(VGS−VT)$^2$. IDS represents the drain-source current of the driving transistor 116.

The voltage stored in the storage capacitor 111 is:

$$VCS = \sqrt{\frac{IP + IB}{\beta}} - VB + VT \tag{10}$$

where VCS represents the voltage stored in the storage capacitor 111.

Since one terminal of the driving transistor 116 is connected to the VGND, the current flowing through the OLED 110 during the programming time is:

$$I\text{pixel} = IP + IB + \beta\cdot(\text{VB})^2 - 2\sqrt{\beta}\cdot VB\cdot\sqrt{(IP+IB)} \tag{11}$$

where Ipixel represents the pixel current flowing through the OLED 110.

If IB>>IP, the pixel current Ipixel can be written as:

$$I\text{pixel} = IP + (IB + \beta\cdot(VB)^2 - 2\sqrt{\beta}\cdot VB\cdot\sqrt{IB}) \tag{12}$$

VB is chosen properly as follows:

$$VB = \sqrt{\frac{IB}{\beta}} \tag{13}$$

The pixel current Ipixel becomes equal to the programming current IP. Therefore, it avoids unwanted emission during the programming cycle.

Since resizing is not required, a better matching between two mirror transistors in the current-mirror pixel circuit can be achieved.

FIG. 20 illustrates a pixel circuit 214 having p-type transistors. The pixel circuit 214 corresponds to the pixel circuit 212 of FIG. 18. The pixel circuit 214 employs the VBCP driving scheme as shown FIG. 21. The pixel circuit 214 includes an OLED 130, a storage capacitor 131, a switch network 132, and mirror transistors 134 and 136. The mirror transistors 134 and 136 form a current mirror. The transistor 134 is a programming transistor. The transistor 136 is a driving transistor. The switch network 132 includes switch transistors 138 and 140. The transistors 134, 136, 138 and 140 are p-type TFT transistors. Each of the transistors 134, 136, 138 and 140 has a gate terminal, a first terminal and a second terminal.

The transistors 134, 136, 138 and 140 may be fabricated using amorphous silicon, nano/micro crystalline silicon, poly silicon, organic semiconductors technologies (e.g. organic TFTs), PMOS technology, or CMOS technology (e.g. MOSFET). A plurality of pixel circuits 214 may form an AMOLED display array.

A select line SEL, a signal line DATA, a virtual grand line VGND, and a voltage supply line VSS are provided to the pixel circuit 214.

The transistor 136 is connected between the VGND and the cathode electrode of the OLED 130. The gate terminal of the transistor 134, the gate terminal of the transistor 136, the storage capacitor 131 and the switch network 132 are connected at node A42.

Figure 21:
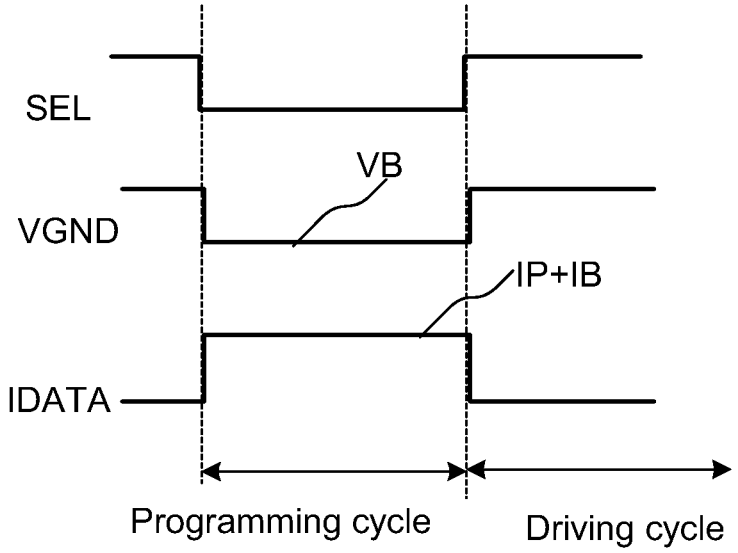
FIG. 21 is a timing diagram showing exemplary waveforms applied to the pixel circuit of FIG. 20.

FIG. 21 illustrates an exemplary operation for the pixel circuit 214 of FIG. 20. FIG. 21 corresponds to FIG. 19. The VBCP driving scheme of FIG. 21 uses IDATA and VGND similar to those of FIG. 19.

The VBCP technique applied to the pixel circuit 212 and 214 is applicable to current programmed pixel circuits other than current mirror type pixel circuit.

For example, the VBCP technique is suitable for the use in AMOLED displays. The VBCP technique enhances the settling time of the current-programmed pixel circuits display, e.g. AMOLED displays.

It is noted that a driver for driving a display array having a VBCP pixel circuit (e.g. 212, 214) converts the pixel luminance data into current.

Figure 22:
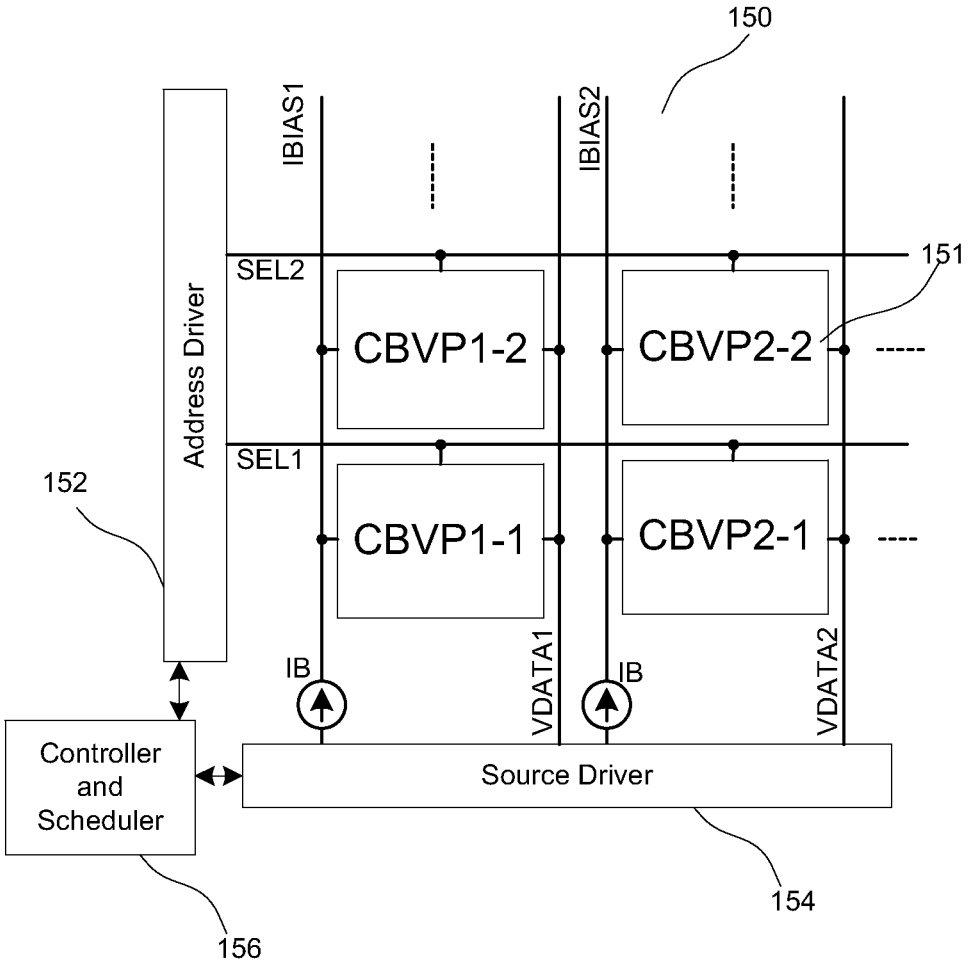
FIG. 22 is a diagram showing a driving mechanism for a display array having CBVP pixel circuits.

FIG. 22 illustrates a driving mechanism for a display array 150 having a plurality of CBVP pixel circuits 151 (CBVP1-1, CBVP1-2, CBVP2-1, CBVP2-2). The CBVP pixel circuit 151 is a pixel circuit to which the CBVP driving scheme is applicable. For example, the CBVP pixel circuit 151 may be the pixel circuit shown in FIG. 1, 5, 8, 10, 12 or 16. In FIG. 22, four CBVP pixel circuits 151 are shown as example. The display array 150 may have more than four or less than four CBVP pixel circuits 151.

The display array 150 is an AMOLED display where a plurality of the CBVP pixel circuits 151 are arranged in rows and columns. VDATA1 (or VDATA 2) and IBIAS1 (or IBIAS2) are shared between the common column pixels while SEL1 (or SEL2) is shared between common row pixels in the array structure.

The SEL1 and SEL2 are driven through an address driver 152. The VDATA1 and VDATA2 are driven through a source driver 154. The IBIAS1 and IBIAS2 are also driven through the source driver 154. A controller and scheduler 156 is provided for controlling and scheduling programming, calibration and other operations for operating the display array, which includes the control and schedule for the CBVP driving scheme as described above.

Figure 23:
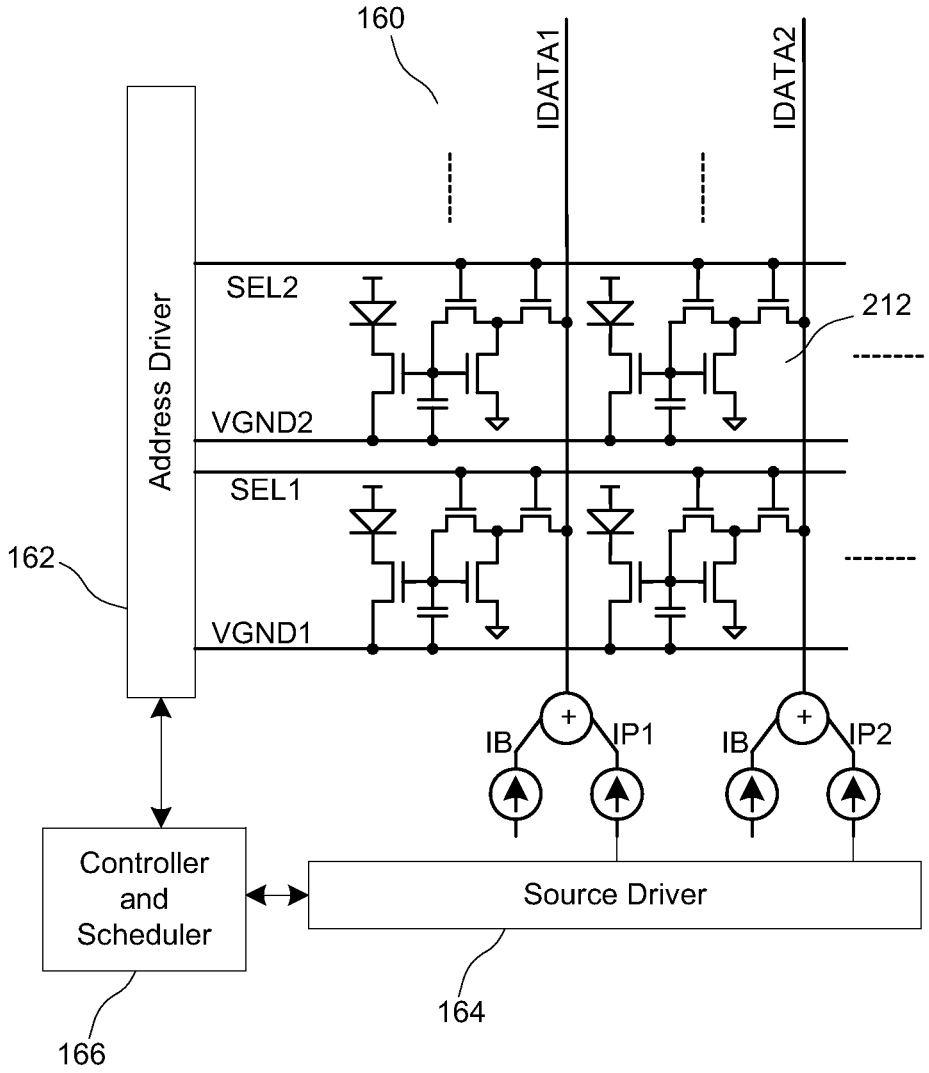
FIG. 23 is a diagram showing a driving mechanism for a display array having VBCP pixel circuits.

FIG. 23 illustrates a driving mechanism for a display array 160 having a plurality of VBCP pixel circuits. In FIG. 23, the pixel circuit 212 of FIG. 18 is shown as an example of the VBCP pixel circuit. However, the display array 160 may include any other pixel circuits to which the VBCP driving scheme described is applicable.

SEL1 and SEL2 of FIG. 23 correspond to SEL of FIG. 18. VGND1 and VGAND2 of FIG. 23 correspond to VDATA of FIG. 18. IDATA1 and IDATA 2 of FIG. 23 correspond to DATA of FIG. 18. In FIG. 23, four VBCP pixel circuits are shown as example. The display array 160 may have more than four or less than four VBCP pixel circuits.

The display array 160 is an AMOLED display where a plurality of the VBCP pixel circuits are arranged in rows and columns. IDATA1 (or IDATA2) is shared between the common column pixels while SEL1 (or SEL2) and VGND1 (or VGND2) are shared between common row pixels in the array structure.

The SEL1, SEL2, VGND1 and VGND2 are driven through an address driver 162. The IDATA1 and IDATA are driven through a source driver 164. A controller and scheduler 166 is provided for controlling and scheduling programming, calibration and other operations for operating the display array, which includes the control and schedule for the VBCP driving scheme as described above.

Figure 24:
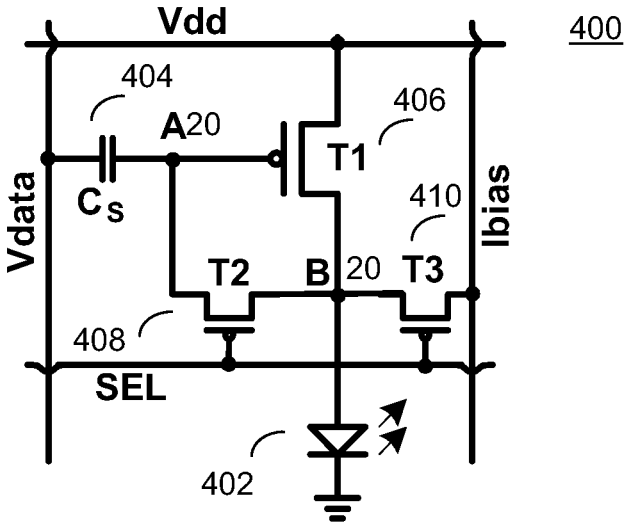
FIG. 24 is a diagram showing a pixel circuit in accordance with a further embodiment of the present invention.

FIG. 24 illustrates a pixel circuit 400 in accordance with a further embodiment of the present invention. The pixel circuit 400 of FIG. 24 is a 3-TFT current-biased voltage programmed pixel circuit and employs the CBVP driving scheme. The driving scheme improves the display lifetime and yield by compensating for the mismatches.

The pixel circuit 400 includes an OLED 402, a storage capacitor 404, a driving transistor 406, and switch transistors 408 and 410. Each transistor has a gate terminal, a first terminal and a second terminal. The transistors 406, 408 and 410 are p-type TFT transistors. The driving technique applied to the pixel circuit 400 is also applicable to a complementary pixel circuit having n-type transistors as well understood by one of ordinary skill in the art.

The transistors 406, 408 and 410 may be implemented using poly silicon, nano/micro (crystalline) silicon, amorphous silicon, CMOS, organic semiconductor, metal organic technologies, or combination thereof. A plurality of pixel circuits 400 may form an active matrix array. The driving scheme applied to the pixel circuit 400 compensates for temporal and spatial non-uniformities in the active matrix display.

A select line SEL, a signal line Vdata, a bias line Ibias, and a voltage supply line Vdd are connected to the pixel circuit 400. The bias line Ibias provides a bias current (Ibias) that is defined based on display specifications, such as lifetime, power, and device performance and uniformity.

The first terminal of the driving transistor 406 is connected to the voltage supply line Vdd. The second terminal of the driving transistor 406 is connected to the OLED 402 at node B20. One terminal of the capacitor 404 is connected to the signal line Vdata, and the other terminal of the capacitor 404 is connected to the gate terminal of the driving transistor 406 at node A20.

The gate terminals of the switch transistors 408 and 410 are connected to the select line SEL. The switch transistor 408 is connected between node A20 and node B20. The switch transistor 410 is connected between the node B20 and the bias line Ibias.

For the pixel circuit 400, a predetermined fixed current (Ibias) is provided through the transistor 410 to compensate for all spatial and temporal non-uniformities and voltage programming is used to divide the current in different current levels required for different gray scales.

Figure 25:
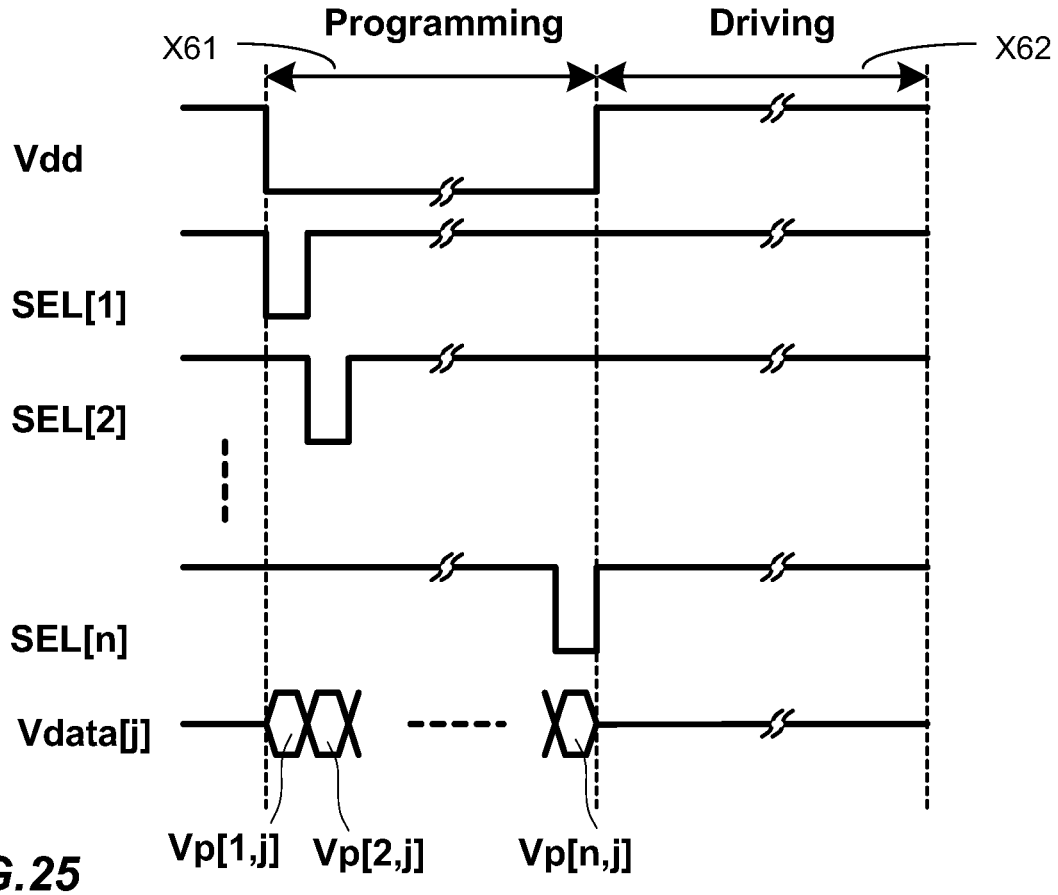
FIG. 25 is a timing diagram showing exemplary waveforms applied to the pixel circuit of FIG. 24.

As shown in FIG. 25, the operation of the pixel circuit 400 includes a programming phase X61 and a driving phase X62. Vdata [j] of FIG. 25 corresponds to Vdd of FIG. 24. Vp[k,j] of FIG. 25 (k=1, 2, . . . , n) represents the kth programming voltage on Vdata [j] where "j" is the column number.

Referring to FIGS. 24 and 25, during the programming cycle X61, SEL is low so that the switch transistors 408 and 410 are on. The bias current Ibias is applied via the bias line Ibias to the pixel circuit 400, and the gate terminal of the driving transistor 406 is self-adjusted to allow all the current passes through source-drain of the driving transistor 406. At this cycle, Vdata has a programming voltage related to the gray scale of the pixel. During the driving cycle X62, the switch transistors 408 and 410 are off, and the current passes through the driving transistor 406 and the OLED 402.

Figure 26:
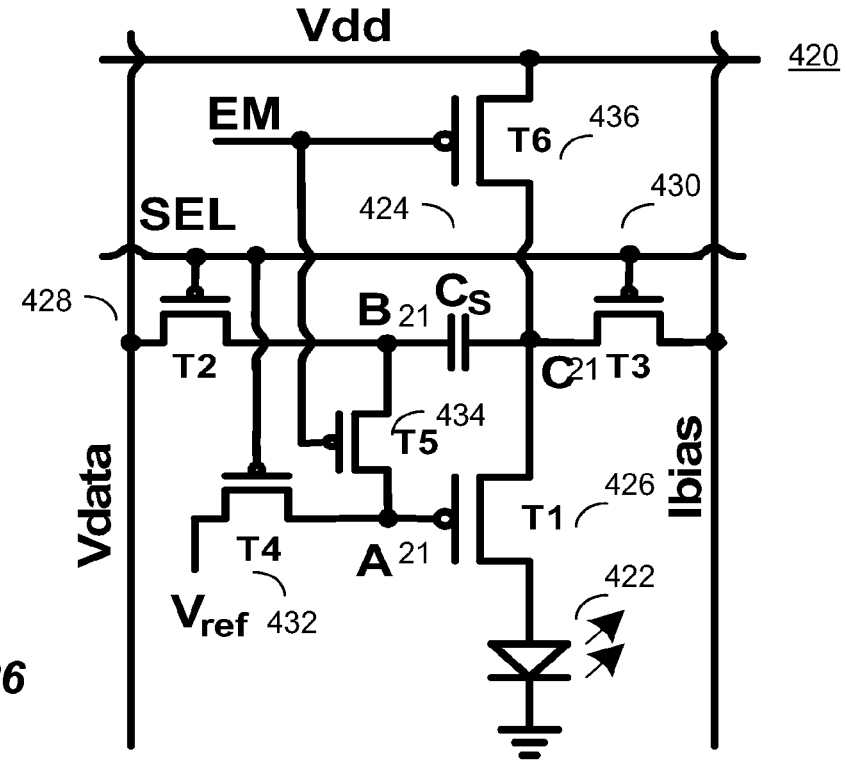
FIG. 26 is a diagram showing a pixel circuit in accordance with a further embodiment of the present invention.

FIG. 26 is a diagram showing a pixel circuit 420 in accordance with a further embodiment of the present invention. The pixel circuit 420 of FIG. 26 is a 6-TFT current-biased voltage programmed pixel circuit and employs the CBVP driving scheme, with emission control. This driving scheme improves the display lifetime and yield by compensating for the mismatches.

The pixel circuit 420 includes an OLED 422, a storage capacitor 424, and transistors 426-436. Each transistor has a gate terminal, a first terminal and a second terminal. The transistors 426-436 are p-type TFT transistors. The driving technique applied to the pixel circuit 420 is also applicable to a complementary pixel circuit having n-type transistors as well understood by one of ordinary skill in the art.

The transistors 426-436 may be implemented using poly silicon, nano/micro (crystalline) silicon, amorphous silicon, CMOS, organic semiconductor, metal organic technologies, or combination thereof. A plurality of pixel circuits 420 may form an active matrix array. The driving scheme applied to the pixel circuit 420 compensates for temporal and spatial non-uniformities in the active matrix display.

One select line SEL, a signal line Vdata, a bias line Ibias, a voltage supply line Vdd, a reference voltage line Vref, and an emission signal line EM are connected to the pixel circuit 420. The bias line Ibias provides a bias current (Ibias) that is defined based on display specifications, such as lifetime, power, and device performance and uniformity. The reference voltage line Vref provides a reference voltage (Vref). The reference voltage Vref may be determined based on the bias current Ibias and the display specifications that may include gray scale and/or contrast ratio. The signal line EM provides an emission signal EM that turns on the pixel circuit 420. The pixel circuit 420 goes to emission mode based on the emission signal EM.

The gate terminal of the transistor 426, one terminal of the transistor 432 and one terminal of the transistor 434 are connected at node A21. One terminal of the capacitor 424, one terminal of the transistor 428 and the other terminal of the transistor 434 are connected at node B21. The other terminal of the capacitor 424, one terminal of the transistor 430, one terminal of the transistor 436, and one terminal of the transistor 426 are connected at node C21. The other terminal of the transistor 430 is connected to the bias line Ibias. The other terminal of the transistor 432 is connected to the reference voltage line Vref. The select line SEL is connected to the gate terminals of the transistors 428, 430 and 432. The select line EM is connected to the gate terminals Of the transistors 434, and 436. The transistor 426 is a driving transistor. The transistors 428, 430, 432, 434, and 436 are switching transistors.

For the pixel circuit 420, a predetermined fixed current (Ibias) is provided through the transistor 430 while the reference voltage Vref is applied to the gate terminal of the transistor 426 through the transistor 432 and a programming voltage VP is applied to the other terminal of the storage capacitor 424 (i.e., node B21) through the transistor 428. Here, the source voltage of the transistor 426 (i.e., voltage of node C21) will be self-adjusted to allow the bias current goes through the transistor 426 and thus it compensates for all spatial and temporal non-uniformities. Also, voltage programming is used to divide the current in different current levels required for different gray scales.

Figure 27:
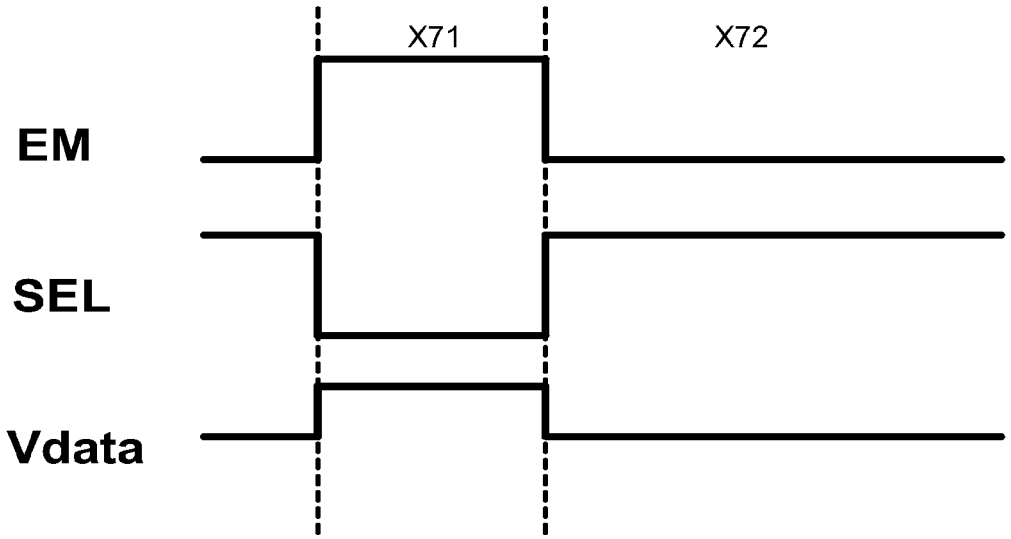
FIG. 27 is a timing diagram showing exemplary waveforms applied to the pixel circuit of FIG. 26.

As shown in FIG. 27, the operation of the pixel circuit 420 includes a programming phase X71 and a driving phase X72.

Referring to FIGS. 26 and 27, during the programming cycle X71, SEL is low so that the transistors 428, 430 and 432 are on, a fixed bias current is applied to Ibias line, and the source of the transistor 426 is self-adjusted to allow all the current passes through source-drain of the transistor 426. At this cycle, Vdata has a programming voltage related to the gray scale of the pixel and the capacitor 424 stores the programming voltage and the voltage generated by current for mismatch compensation. During the driving cycle X72, the transistors 428, 430 and 432 are off, while the transistors 434 and 436 are on by the emission signal EM. During this driving cycle X72, the transistor 426 provides current for the OLED 422.

In FIG. 25, the entire display is programmed, then it is light up (goes to emission mode). By contrast, in FIG. 27, each row can light up after programming by using the emission line EM.

In the operations of FIGS. 25 and 27, the bias line provides a predetermined fixed bias current. However, the bias current Ibias may be adjustable, and the bias current Ibias may be adjusted during the operation of the display.

Figure 28:
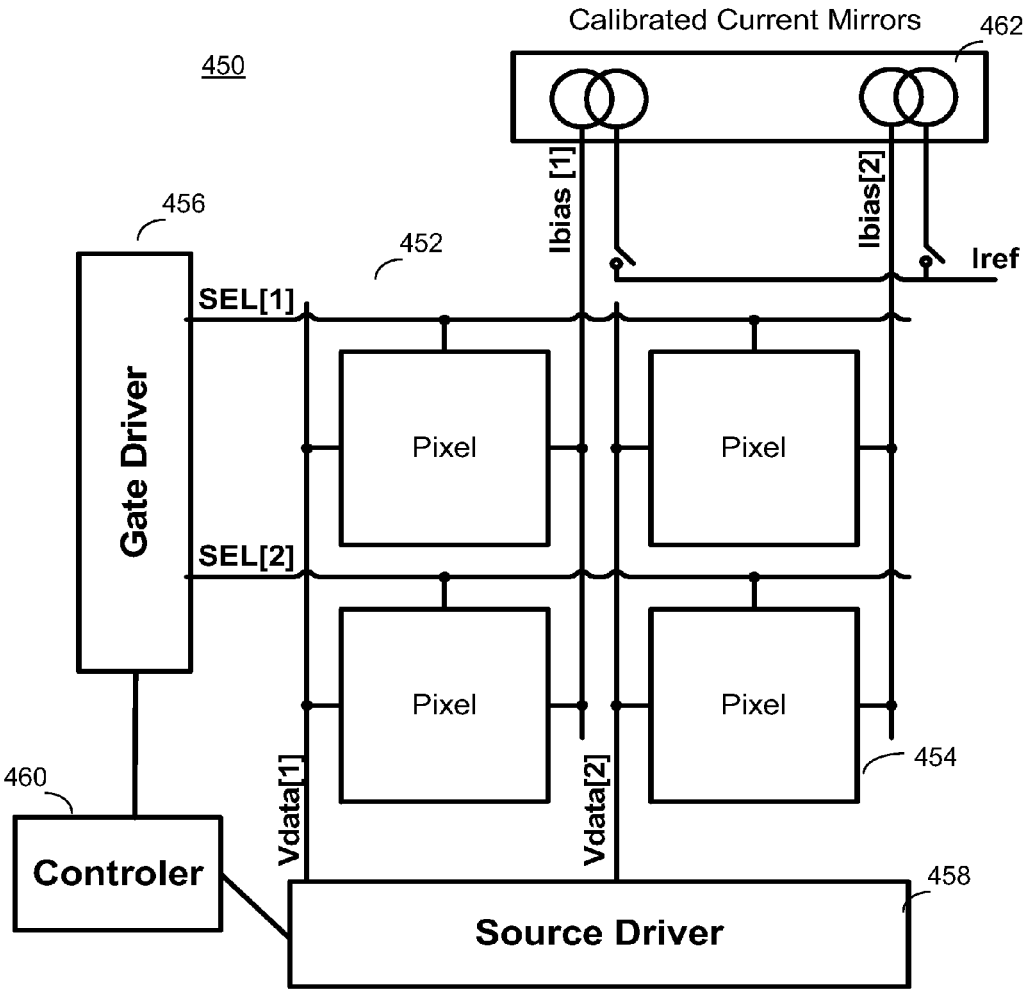
FIG. 28 is a diagram showing a further example of a display system having CBVP pixel circuits.

FIG. 28 illustrates an example of a display system having array structure for implementation of the CBVP driving scheme. The display system 450 of FIG. 28 includes a pixel array 452 having a plurality of pixels 454, a gate driver 456, a source driver 458 and a controller 460 for controlling the drivers 456 and 458. The gate driver 456 operates on address (select) lines (e.g., SEL[1], SEL[2], . . . ). The source driver 458 operates on data lines (e.g., Vdata [1], Vdata [2], . . . ). The display system 450 includes a calibrated current mirrors block 462 for operating on bias lines (e.g., Ibias [1], Ibias [2]) using a reference current Iref. The block 462 includes a plurality of calibrated current mirrors, each for the corresponding Ibias. The reference current Iref may be provided to the calibrated current mirrors block 462 through a switch.

The pixel circuit 454 may be the same as the pixel circuit 400 of FIG. 24 or the pixel circuit 420 of FIG. 26 where SEL [i] (i=1, 2, . . . ) corresponds to SEL of FIG. 24 or 26, Vdata [j] (j=1, 2, . . . ) corresponds to Vdata of FIG. 24 or 26, and Ibias [j] (j=1, 2, . . . ) corresponds to Ibias of FIG. 24 or 26. When using the pixel circuit 420 of FIG. 26 as the pixel circuit 454, a driver at the peripheral of the display, such as the gate driver 456, controls each emission line EM.

In FIG. 28, the current mirrors are calibrated with a reference current source. During the programming cycle of the panel (e.g., X61 of FIG. 25, X71 of FIG. 27), the calibrated current mirrors (block 462) provide current to the bias line Ibias. These current mirrors can be fabricated at the edge of the panel.

Figure 29:
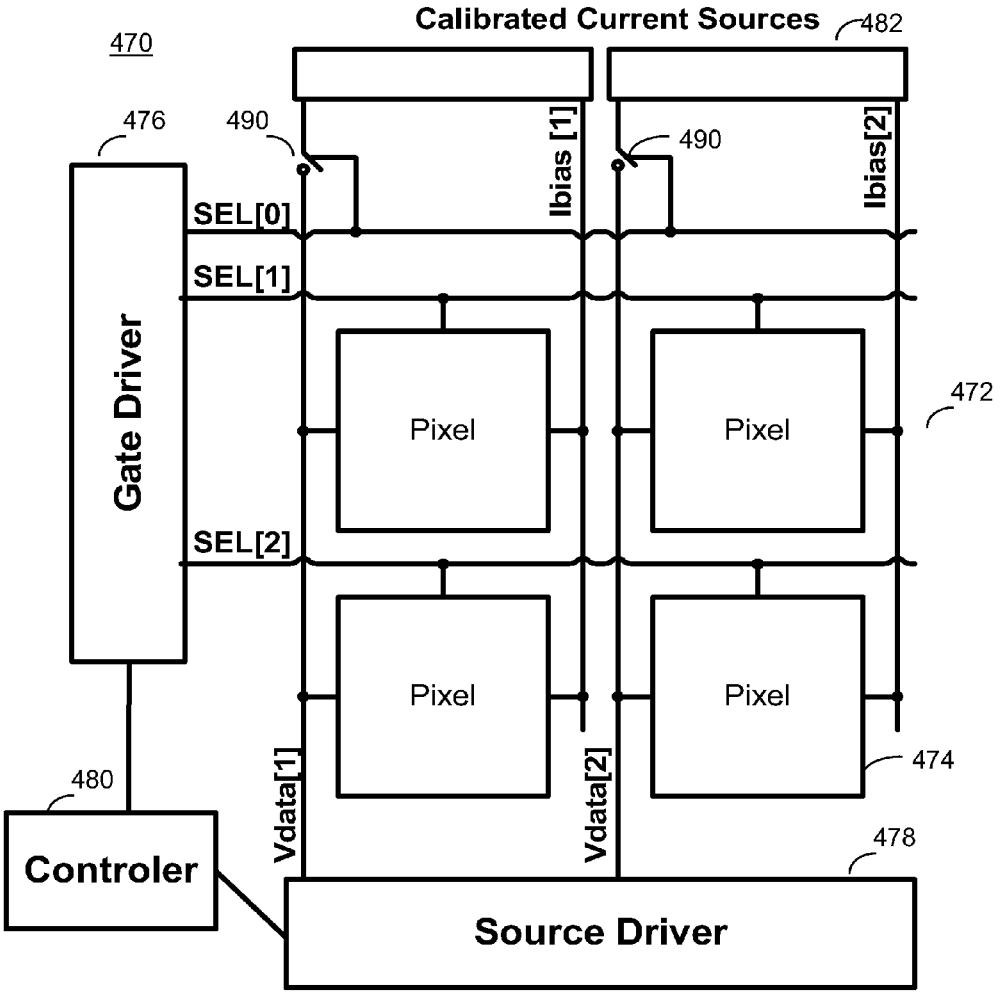
FIG. 29 is a diagram showing a further example of a display system having CBVP pixel circuits.

FIG. 29 illustrates another example of a display system having array structure for implementation of the CBVP driving scheme. The display system 470 of FIG. 29 includes a pixel array 472 having a plurality of pixels 474, a gate driver 476, a source driver 478 and a controller 480 for controlling the drivers 476 and 478. The gate driver 476 operates on address (select) lines (e.g., SEL[0], SEL [1], SEL[2], . . . ). The source driver 478 operates on data lines (e.g., Vdata [1], Vdata [2], . . . ). The display system 470 includes a calibrated current sources block 482 for operating on bias lines (e.g., Ibias [1], Ibias [2]) using Vdata lines. The block 482 includes a plurality of calibrated current sources, each being provided for the Ibias line.

The pixel circuit 474 may be the same as the pixel circuit 400 of FIG. 24 or the pixel circuit 420 of FIG. 26 where SEL [i] (i=1, 2, . . . ) corresponds to SEL of FIG. 24 or 26, Vdata [j] (j=1, 2, . . . ) corresponds to Vdata of FIG. 24 or 26, and Ibias [j] (j=1, 2, . . . ) corresponds to Ibias of FIG. 24 or 26. When using the pixel circuit 420 of FIG. 26 as the pixel circuit 474, a driver at the peripheral of the display, such as the gate driver 456, controls each emission line EM.

Each current source 482 includes a voltage to current convertor that converts voltage via Vdata line to current. One of the select lines is used to operate a switch 490 for connecting Vdata line to the current source 482. In this example, address line SEL [0] operates the switch 490. The current sources 482 are treated as one row of the display (i.e., the $0^{th}$ row). After the conversion of voltage on Vdata line at the current source 482, Vdata line is used to program the real pixel circuits 474 of the display.

A voltage related to each of the current sources is extracted at the factory and is stored in a memory (e.g. flash, EPROM, or PROM). This voltage (calibrated voltage) may be different for each current source due to their mismatches. At the beginning of each frame, the current sources 482 are programmed through the source driver 478 using the stored calibrated voltages so that all the current sources 482 provides the same current.

In FIG. 28, the bias current (Ibias) is generated by the current mirror 462 with the reference current Iref. However, the system 450 of FIG. 28 may use the current source 482 to generate Ibias. In FIG. 29, the bias current (Ibias) is generated by the current converter of the current source 482 with Vdata line. However, the system 470 of FIG. 29 may use the current mirror 462 of FIG. 28.

Figure 30:
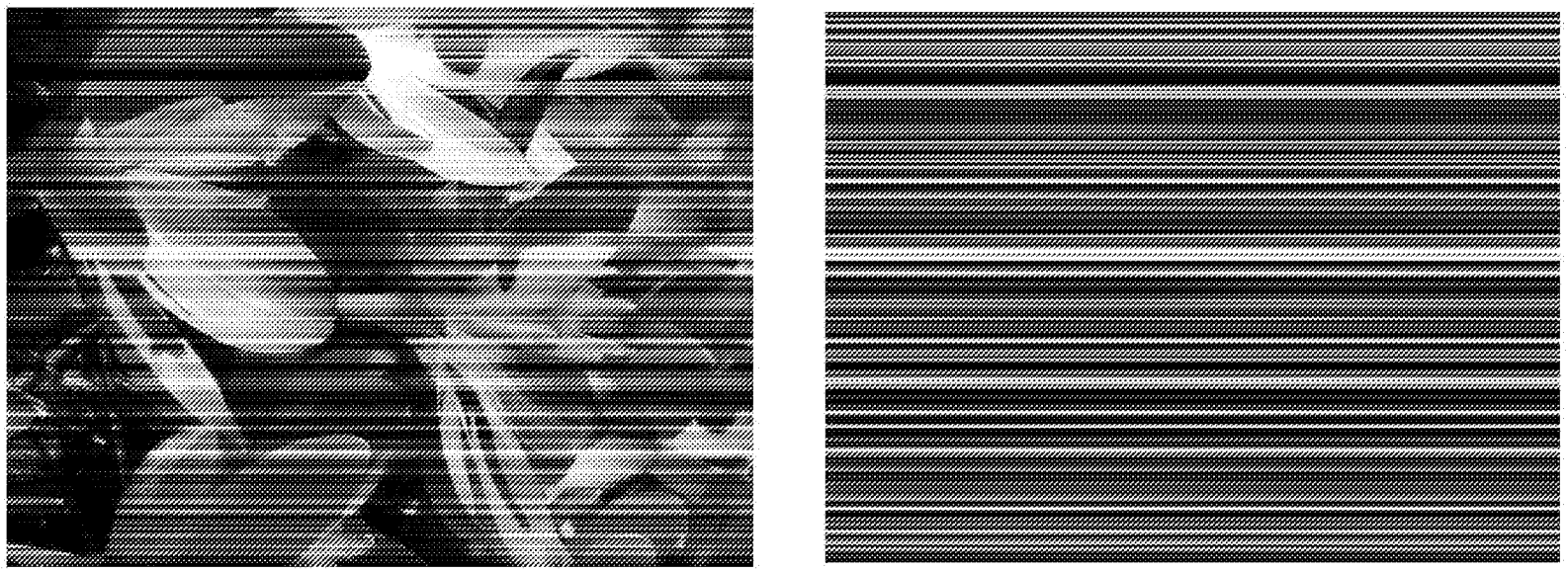
FIG. 30 is a photograph showing effect of spatial mismatches on a display using a simple 2-TFT pixel circuit.
Figure 32:
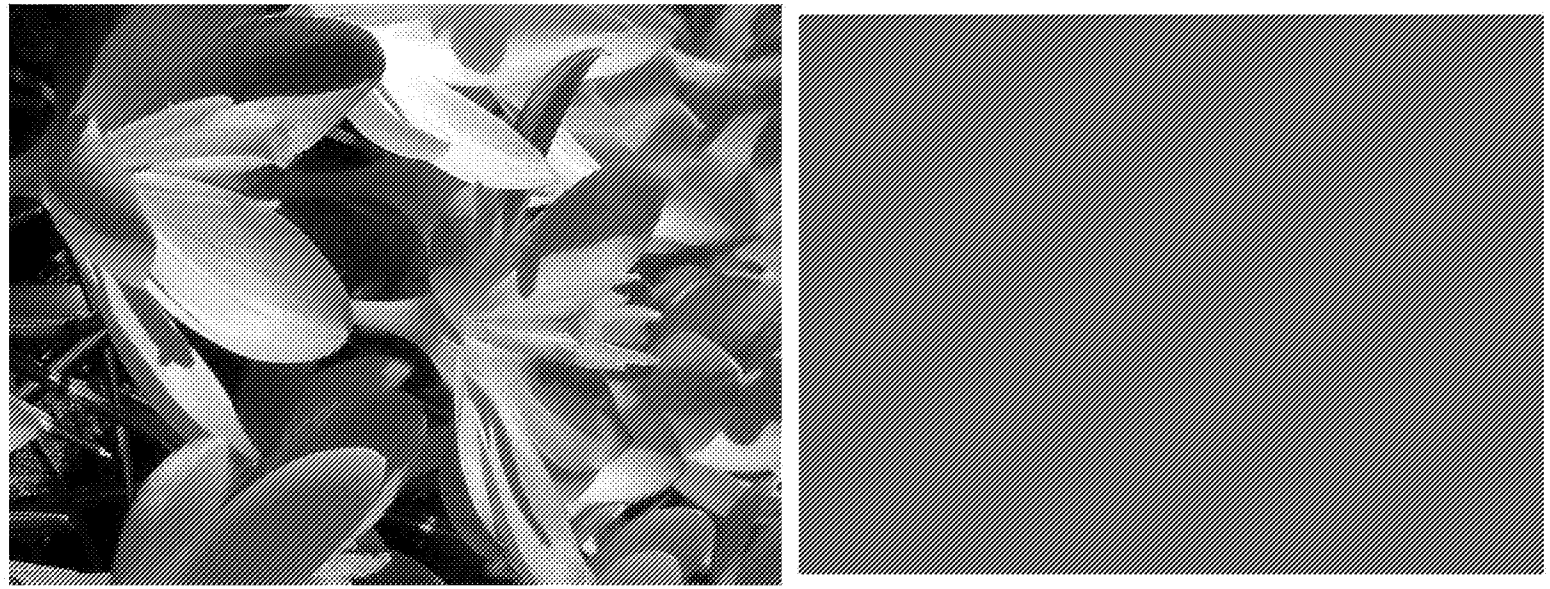
FIG. 32 is a photograph showing effect of spatial mismatches on a display using CBVP pixel circuit.

Effect of spatial mismatches on the image quality of panels using different driving scheme is depicted in FIGS. 30-32. The image of display with conventional 2-TFT pixel circuit is suffering from both threshold voltage mismatches and mobility variations (FIG. 30). On the other hand, the voltage programmed pixel circuits without the bias line Ibias may control the effect of threshold voltage mismatches, however, they may suffer from the mobility variations (FIG. 31) whereas the current-biased voltage-programmed (CBVP) driving scheme in the embodiments can control the effect of both mobility and threshold voltage variations (FIG. 32).

The present invention has been described with regard to one or more embodiments. However, it will be apparent to persons skilled in the art that a number of variations and modifications can be made without departing from the scope of the invention as defined in the claims.

What is claimed is:

1. A pixel circuit comprising:

a light emitting device;

a storage capacitor;

a driving transistor for providing a pixel current to the light emitting device, the driving transistor having a gate terminal, a first terminal connected to the storage capacitor, and a second terminal connected to the light emitting device;

a first switch transistor electrically connected between a bias line and the first terminal of the driving transistor; and a second switch transistor electrically connected between a reference voltage line and the gate terminal of the driving transistor; and an emission control transistor having a gate terminal connected to an emission control line, a first terminal connected to a voltage supply line different from the reference voltage line, and a second terminal connected to the first terminal of the driving transistor.

2. The pixel circuit according to claim 1, wherein the first switch transistor and the second voltage switch transistor set the voltage across the gate and the first terminal of the driving transistor during a programming cycle.

3. The pixel circuit according to claim 2, wherein the emission control transistor disconnects the driving transistor from the voltage supply line during the programming cycle.

4. The pixel circuit according to claim 1, further comprising a third switch transistor that connects the storage capacitor to the gate of the driving transistor during a driving cycle in which the light emitting device emits light.

5. The pixel circuit according to claim 1, further comprising a fourth switch transistor that connects the storage capacitor to a data voltage line during a programming cycle.

* * * * *